United States Patent [19]

Iszczukiewicz

[11] 4,079,921

[45] Mar. 21, 1978

[54] APPARATUS AND METHOD FOR CONTINUOUS TREATMENT OF METAL COILS OR THE LIKE

[75] Inventor: Ludwik Iszczukiewicz, Parma Heights, Ohio

[73] Assignee: Lee Wilson Engineering Company, Inc., Cleveland, Ohio

[21] Appl. No.: 697,370

[22] Filed: Jun. 18, 1976

[51] Int. Cl.[2] ..... C21D 9/54

[52] U.S. Cl. ..... 266/252; 432/260

[58] Field of Search ..... 148/16, 16.5, 16.6, 148/16.7, 155; 266/249, 251, 252, 254, 257; 432/133, 143, 144, 207, 242, 249, 260; 198/773–776, 952

[56] References Cited

U.S. PATENT DOCUMENTS

| | | | |
|---|---|---|---|
| 2,996,293 | 8/1961 | Fallon | 266/252 |
| 3,063,878 | 11/1962 | Wilson | 432/260 |
| 3,189,336 | 6/1965 | Montagino | 266/252 |
| 3,446,491 | 5/1969 | Espenschied et al. | 432/122 |
| 3,554,505 | 1/1971 | Dessarts | 432/249 |
| 3,567,195 | 3/1971 | Kakuta et al. | 266/252 |
| 3,716,222 | 2/1973 | Anderson | 432/133 |
| 3,778,221 | 12/1973 | Bloom | 266/252 |

*Primary Examiner*—Gerald A. Dost

*Attorney, Agent, or Firm*—Bosworth, Sessions & McCoy

[57] ABSTRACT

Apparatus and process are disclosed whereby open coils having spaces between the convolutions may be treated in a longitudinally extending furnace by passage of treating gases between the convolutions of the coils, the coils being introduced at one end of the furnace, passed through the furnace while being treated, and removed from the other end of the furnace. Walking beam apparatus is disclosed having sealing means, disclosed as a trough and flange sealing means that prevents gas leakage between the lower portion of the walking beam apparatus and the atmosphere, so that a completely gas sealed enclosure may be provided above the walking beams. Transfer means are disclosed at the entrance and discharge ends of the furnace, for introducing coils into the furnace and removing them from the furnace through purge chambers. A coil support that travels with the coil through the furnace is disclosed. Processes are also disclosed for continuously treating open coils.

39 Claims, 41 Drawing Figures

-0-
-0-
-0-
-0-
-0-
-0-
256
4
43
42
36
25
15
6
101
106
107
108
109
110
113
114
117
118
122
123
124
125
126
127
128
129
130
131
132
133
134
135
152
153
154
155
156
157
158
159
174
175
176
177
178
119
120
121
44
F

FIG. 10
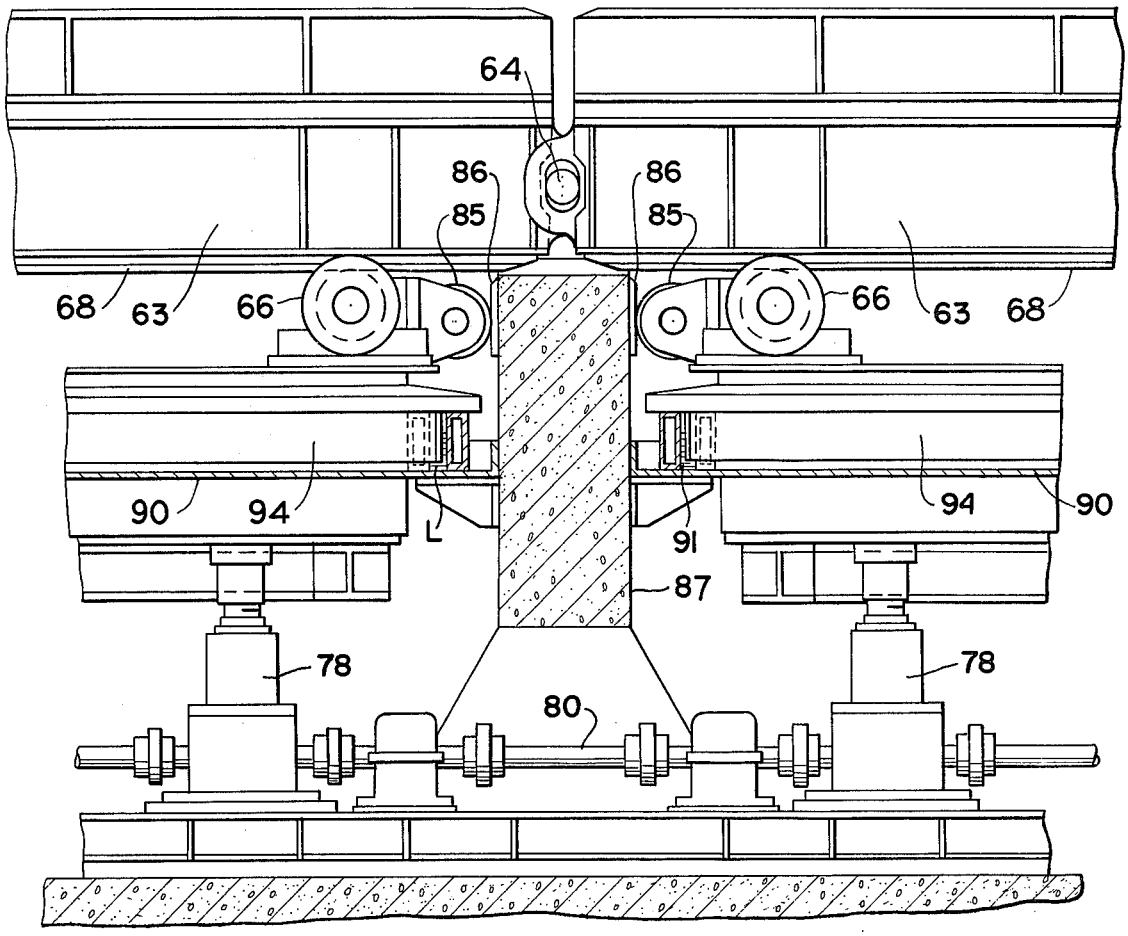
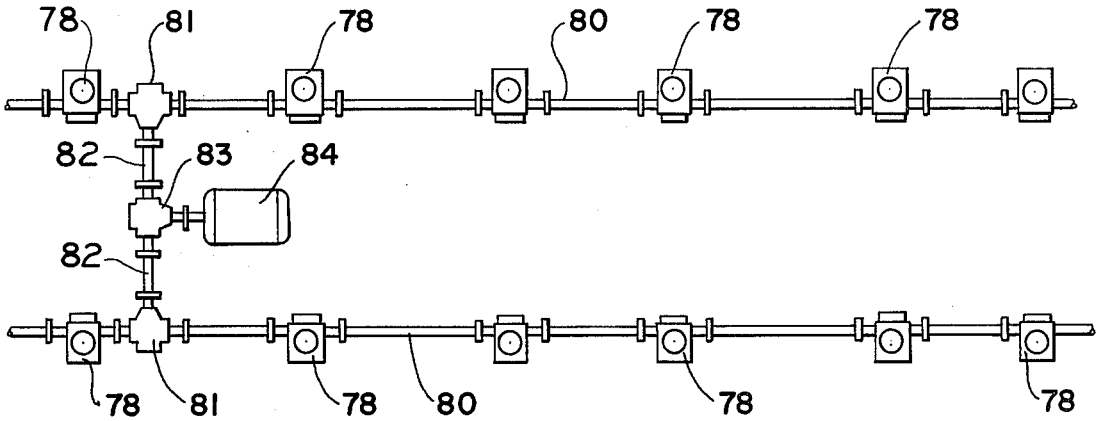
FIG. 11

23
23
23
23
9
8
126
127
136
137
138
139
143
144
145
146
151
158
159
183
184
185
186
187
188
189
190
191
192
193
194
195
196
197
198
199

APPARATUS AND METHOD FOR CONTINUOUS TREATMENT OF METAL COILS OR THE LIKE

BACKGROUND OF THE INVENTION

This invention relates to the continuous treatment in a gaseous atmosphere secluded from the ambient atmosphere of heavy or large objects, such as coils of strip material, and to apparatus and process advantageous for such treatment, as well as for other purposes.

While the invention in certain aspects is applicable to the continuous treatment of other types of heavy or large objects, it provides particular important advantages in the treatment of coils of strip metal, and particularly open coils of strip metal, and therefore will be described hereinafter primarily in connection with heat treatment of such coils.

In the open coil heat treatment of strip metal, a tight wound coil of strip metal is first recoiled into an open coil in which the spiral convolutions of the strip metal in the coil are spaced apart. While such an open coil is supported with its axis vertical on a base structure, a suitable heated treating gas is caused to flow through the spaces between the convolutions of the coil to contact both sides of the metal strip and thus rapidly and effectively treat the metal.

In heat treatment such as annealing, the steel strip in an open coil may be heated to as high as 1750° F. by passing a suitable heated gas through the spaces between the convolutions of the coil. Other open coil treatments may involve modifying the chemical composition of the metal strip. For example, the carbon content of steel strip may be modified by the use of a suitable gas. Furthermore, treatments may involve oxidation, bright annealing, gas alloying, and treatments involving the application to the surfaces of the strip metal of materials that will react with constituents of the metal and treatment of such surfaces by passing a suitably heated gas between the spaced strip convolutions.

Heretofore, the heat treatment of such an open coil has been often effected in a bell type furnace such as an individual bell type furnace, or by apparatus embodying a plurality of furnaces through which the coils are inserted from a side in an automated apparatus. It is also known to heat treat open coils in a furnace in which the coils are supported on a hearth that rotates about a vertical axis that passes gases between the convolutions of each coil in a plurality of segregated stations.

Although the heat treatment of open coils are set forth above has proven to be a great improvement over the heat treatment of tight wound coils, the above described prior types of apparatus do not provide as many advantages as are deemed desirable. Thus, the individual bell type apparatus requires considerable time for operation due to the necessity of fixing the coil on a suitable support, placing an inner cover over the coil, then placing the bell over the inner cover, heat treating the coil, and then removing the bell and inner cover. The second and third types of apparatus described above, although capable of providing considerable improvements in speed and efficiency of operation over the individual bell apparatus, either require considerable floor space or capital investment, or do not have as high a production capacity as is made possible by the present invention.

SUMMARY OF THE INVENTION

An object of the present invention is to provide apparatus and method for heat treating open coils of strip material whereby greater savings than heretofore possible are effected in first cost of the apparatus required to produce a given output, operating costs are reduced, a highly uniform product is obtained, control of the heat treating operation is facilitated, the time required for heat treating a coil of given size and weight is substantially reduced, and coils of much larger size than heretofore treatable may be successfully treated, and initial capital costs as well as operating costs are substantially reduced.

Another object of the invention is the provision of walking beam apparatus for treating work comprising first longitudinally extending work supporting means having an upwardly facing work supporting surface; second longitudinal work supporting means located generally parallel to and adjacent to the first work supporting means and having an upwardly facing work supporting surface; means for moving one of said work supporting means between a position in which its work supporting surface is above said work supporting surface of the other work supporting means and a position in which its work supporting means is below the work supporting surface of the other work supporting surface of the other work supporting means, means for moving one of the first and second work supporting means in a longitudinal direction extending generally parallel of the other work supporting means, while the work supporting means movable so its work supporting surface is above and below the work supporting surface of the other work supporting means has its work supporting surface in a position above or a position below the work supporting surface of the other work supporting means; gas enclosure means enclosing space above the work supporting means; and gas seal means operating between the gas enclosure means and said work supporting means to prevent passage of gas between the enclosure means and the ambient atmosphere.

Another object is to provide a walking beam furnace adapted to move heavy objects, such as large open coils, from one work station into another work station within the furnace, which walking beam furnace includes a first longitudinally extending work-supporting means having an upwardly facing work supporting surface; second longitudinally extending work supporting means located generally parallel to and adjacent to said first work supporting means and having an upwardly facing work supporting surface; means for moving one of said work supporting means in an upright path between a position in which its work supporting surface is above the work supporting surface of the other work supporting means, and a position in which its work supporting surface is below the work supporting surface of the other work supporting means; means for moving one of the first and second work supporting means in a longitudinal direction extending generally parallel to the other work supporting means, while said work supporting means movable in an upright path is positioned with its work supporting surface above the work supporting surface of the other work supporting means and in an opposite longitudinal direction when the work supporting means movable in an upright path is positioned with its work supporting surface below the work supporting surface of the other work supporting means; and enclosure means enclosing a space above the work supporting means, the enclosure means being substantially impervious to gas after introduction of the work being treated, the enclosure means including wall portions surrounding the work supporting means movable in an upright path; and gas seal means operating between such surrounding wall portions of the enclosure means and the work supporting means movable in an upright path to prevent passage of gas between the enclosure means and the work supporting means movable in an upright path at all times including during such movement of the work supporting means.

Another object is the provision of walking beam apparatus embodying a longitudinally extending enclosure that is substantially gas-tight and includes at one end at least one closure door; a purge chamber adjacent said end of said apparatus connected in gas-tight relation thereto with said enclosure door between said purge chamber and said first mentioned gas tight enclosure; a second door adapted to open and close said purge chamber and spaced from said first door; longitudinally movable walking beam means adapted to move from a position within said purge chamber, to a position outside of said purge chamber where said walking beam means can receive work, then into said purge chamber and then into said gas enclosure.

Another object is the provision of apparatus adapted to cooperate with longitudinally extending walking beam means comprising a support having at least one slot therein extending parallel to said walking beam means and adapted to have walking beam means inserted therein; slot means extending transversely of said first-mentioned slot means adapted to receive transfer car fingers to move an auxiliary support onto said first-mentioned support; and means for moving said first mentioned support in an upright path.

A further object is to provide a coil support unit adapted to support and be moved with a coil, having an upwardly facing coil supporting surface; slot means extending the major portion of the width of said unit and opening through the supporting surface to permit extension into and movable therefrom of coil support bars; transverse wall means in the unit; and means in the unit providing gas passages whereby treating gas may be passed through the unit between the transverse wall means of the unit and the gas openings in the supporting surface of the unit, so that the gas may pass between an open coil on said unit and the unit.

Another object is the provision of a method for continuously treating open coils while they are moved through an elongated furnace, which process comprises moving an open coil into said furnace to a treating station in the furnace, closing the furnace, passing treating gas between the spaced convolutions of the coil while it is stationary at the treating station, then moving the coil to at least one other treating station in the furnace, again passing treating gas between the convolutions of the coil, and then removing the coil from the furnace.

Another object is the provision of such a method comprising the steps of positioning the coil in a closed purge chamber in which atmospheric air is replaced by a gas that is the same as or compatible with the treating gas in the furnace, before the coil is moved into the furnace.

BRIEF DESCRIPTION OF DRAWINGS

FIG. 10 is the side sectional elevation to a larger scale showing a coupling between two main walking beam section, rolls for guiding the walking beams vertically, and lifting jacks for the walking beams;

FIG. 11 is a diagrammatic plan to a smaller scale of drive means for the lifting jacks;

DESCRIPTION OF PREFERRED EMBODIMENT

General Arrangement

Figure 1:
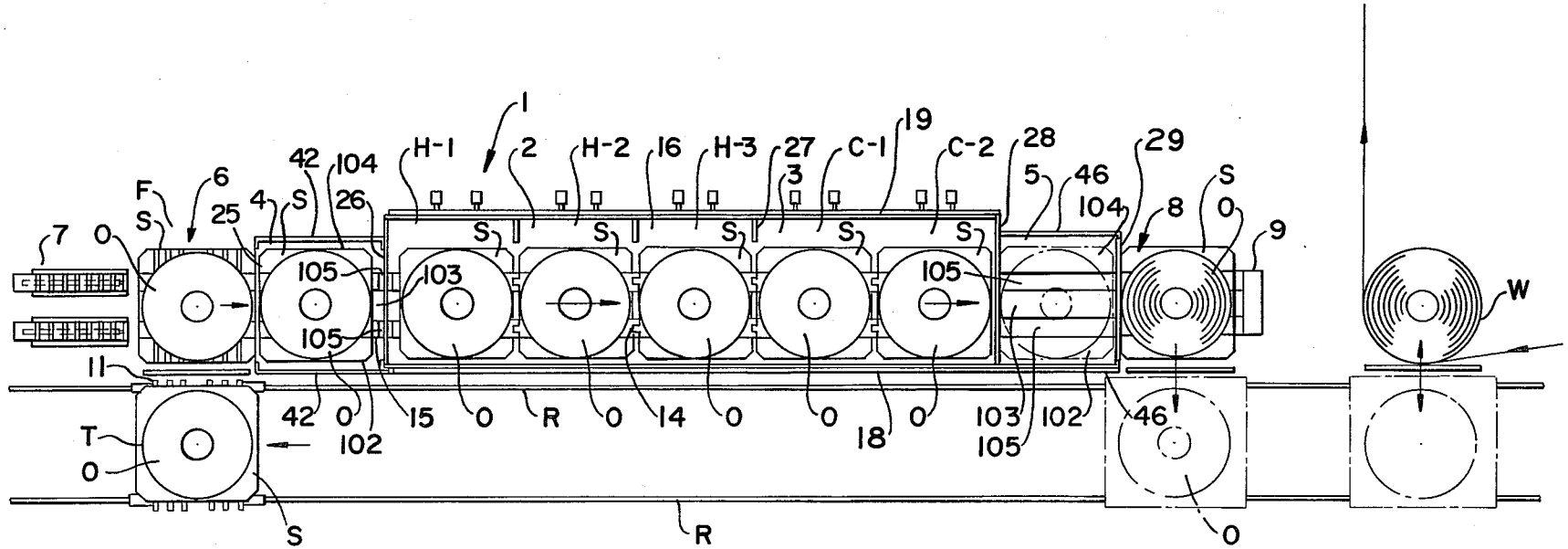
FIG. 1 is a somewhat diagrammatic plan view to a small scale of apparatus embodying the invention for heat treating open coils, the tops of the furnace enclosure and the purge chambers being broken away.
Figure 2:
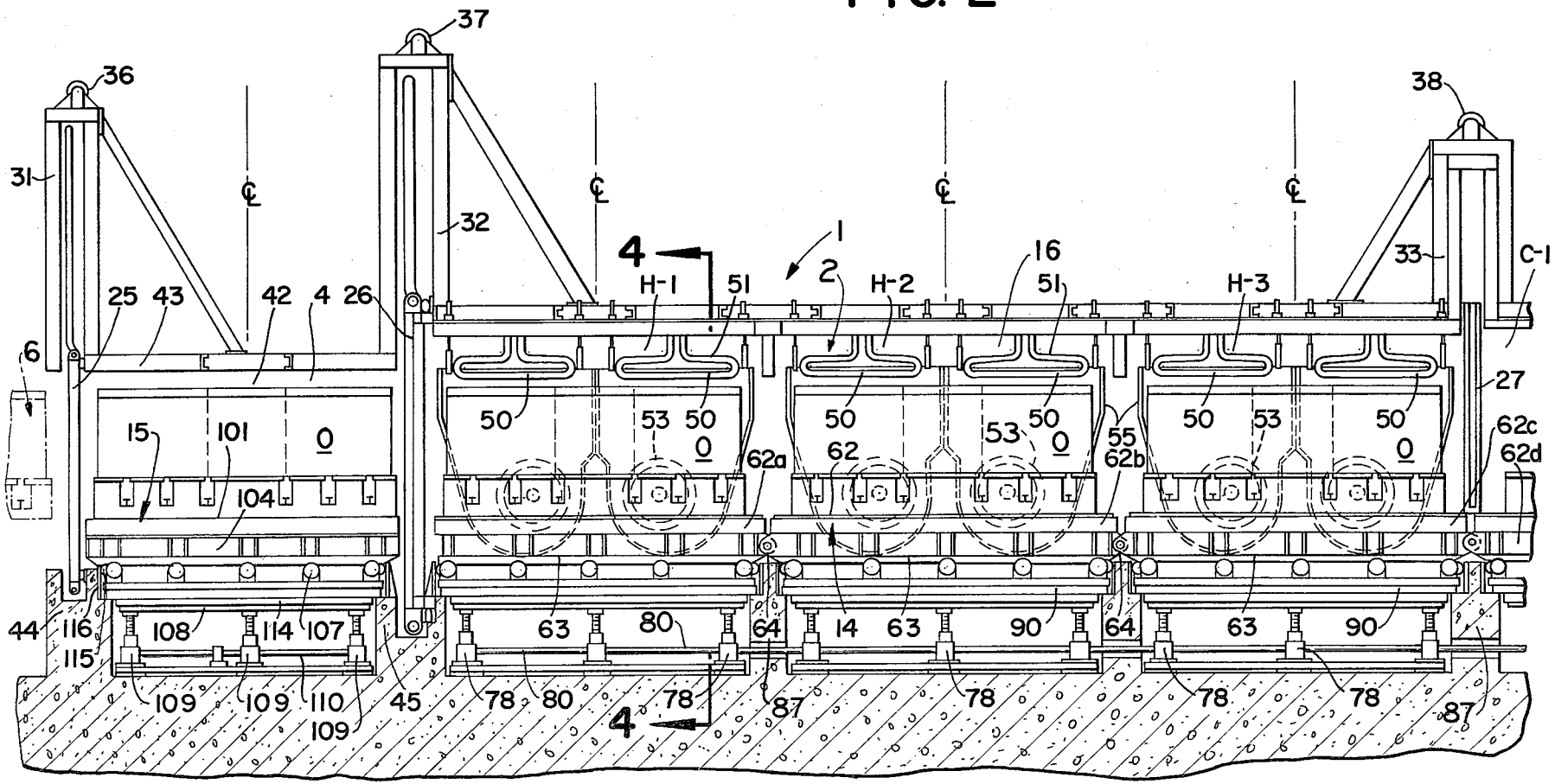
FIG. 2 is a side sectional view to a larger scale of the left-hand end portion of the furnace enclosure and the feed end purge chamber of the apparatus of FIG. 1.

The apparatus illustrated as embodying the invention comprises a longitudinally extending walking beam furnace 1 supported by floor F and having a heating zone 2 and a cooling zone 3, a purge chamber or vestibule 4, adapted to act as a gas lock, at the loading end of the furnace, and a purge chamber or vestibule 5, adapted to act as a gas lock, at the unloading end of the furnace. A loading station 6 with filler beam means 7 to be described later are located adjacent chamber 4 at the loading end of the furnace; and an unloading station 8 with transfer beam means 9 are located adjacent chamber 5 at the unloading end of the furnace.

Open coils O, each previously formed of strip metal spirally wound in spaced convolutions by known means and each supported by an individual coil support unit S, are each moved together with its support unit from loading station 6 into purge chamber 4 in which the coil is stationed while it is segregated from both the ambient atmospheric air and the furnace atmosphere while the atmospheric air in the chamber is replaced by inert gas or by treating gas from the furnace heating zone 2. Thereafter each coil O is sequentially moved on its support unit from chamber 4 into the furnace heating zone 2 in which it is sequentially moved to a position in heating stations H-1, H-2 and H-3. In each of these stations the coil is supported while stationary and while subjected to heat treatment by suitable hot treating gas passing around the coil and through the spaces between the spaced convolutions of the coil. Each coil on its support unit S is also moved sequentially into cooling stations C-1 and C-2 of the cooling zone 3, in which stations the coil is supported stationary while it is cooled by cooling gas passed around the coil and through the spaces between its convolutions.

Thereafter each coil leaving the last cooling station C-2 is individually moved on its support unit S into unloading purge chamber 5 in which the coil is then segregated from the furnace cooling zone while ambient atmospheric air is introduced into the chamber. Each coil is then discharged by being moved from chamber 5 onto unloading station 8 in the ambient atmosphere.

Preferably, as in FIG. 1, the discharged treated coil is then removed from its support unit S on unloading station 8 by a known transfer car T, such as that later described which transfer car travels on a track formed of parallel rails R. The transfer car has transversely extending spaced parallel work supporting and lifting bars 11 that can be raised and lowered and that can be moved longitudinally of the bars and transversely of the car. The transfer car can be controlled to transfer the treated open coil to a known recoiling or winding apparatus W, such as that illustrated in U.S. Pat. No. 3,291,415 dated Dec. 13, 1966, that can rewind the treated open coil into a tightly wound coil of treated metal, which is then removed and stored or shipped by known means.

The transfer car T can also be controlled to deliver an empty coil support unit S from unloading station 8 to, and place it on, loading station 6. Thereafter the transfer car T can deliver an untreated open coil and place it on the coil support S on loading station 6, the coil being delivered from storage, or from the recoiling apparatus W which also can be used to recoil untreated tight wound coils into open coils. Such untreated open coil can then be moved into and through the furnace while the coil is treated as above.

As is apparent from FIG. 1 after the illustrated furnace is fully loaded and in full operation, there are open coils O positioned in and being treated in each of heating stations H-1, H-2, and H-3 and cooling stations C-1, and C-2, while an open coil O awaiting treatment is in purge chamber 4 ready to be moved into the furnace and another coil O is on loading station 6 ready to be moved into chamber 4 and while purge chamber 5 is free of a coil and ready to receive one from the last cooling station C-2.

Each coil in the furnace is moved to and held stationary in a heat treating station and thereafter in a cooling station while it is heated or cooled. The coils are simultaneously moved by walking beam means 14 in the furnace 1, by auxiliary walking beam means 15 operating between the loading station 6 and chamber 4, and by transfer beam means 9 operating between chamber 5 and unloading station 8.

Furnace

The furnace 1 comprises (FIGS. 1–8) an enclosure 16 having top wall 17 and side walls 18 and 19 lined with heat resistant heat insulating material 20, stationary upwardly facing work supporting portions 21, 22 and 23 the supporting surfaces of which are formed of heat resistant material such as fire brick of good mechanical strength, and a floor portion 24; the side walls being connected gas tight to portions 21 and 24. The apparatus has a door 25 between purge chamber 4 and loading station 6, a door 26 between chamber 4 and heating zone 2, an intermediate door 27 adapted when closed to separate the heating and cooling zones 2 and 3, a door 28 between cooling zone 3 and purge chamber 4, and a door 29 between chamber 5 and unloading station 8. Doors 25 to 29 respectively have known upwardly extending enclosures 31, 32, 33, 34 and 35 of which 31, 32, 34 and 35 are gas tight. The doors respectively are adapted to be raised to open position, and lowered to closed gas sealing position, by known operating means 36, 37, 38, 39, 40.

Purge chamber 4 has sidewalls 42 and a top wall 43 formed of gas impervious material, the side walls extending gas-tightly to a work supporting portion and a floor portion to be described, similar to those of furnace enclosure 16. The doors 25 and 26 when closed, respectively are in gas-tight engagement with an upstanding wall portion 44 of the floor F, side walls 42 and top wall 43 of the chamber 4, and with an upstanding wall portion 45 of the floor F, side walls 18, 19 and top wall 17 of furnace enclosure 16.

Purge chamber 5 similarly has side walls 46 and top wall 47, the side walls similarly extending to work supporting and floor portions. Doors 28 and 29, when closed, respectively are in gas-tight engagement with an upstanding wall portion 48 of floor F, side walls 18 and 19, and top wall 17 of furnace enclosure 16, and with an upstanding wall portion 49 of floor F, side walls 46 and top wall 47 of chamber 5.

Figure 4:
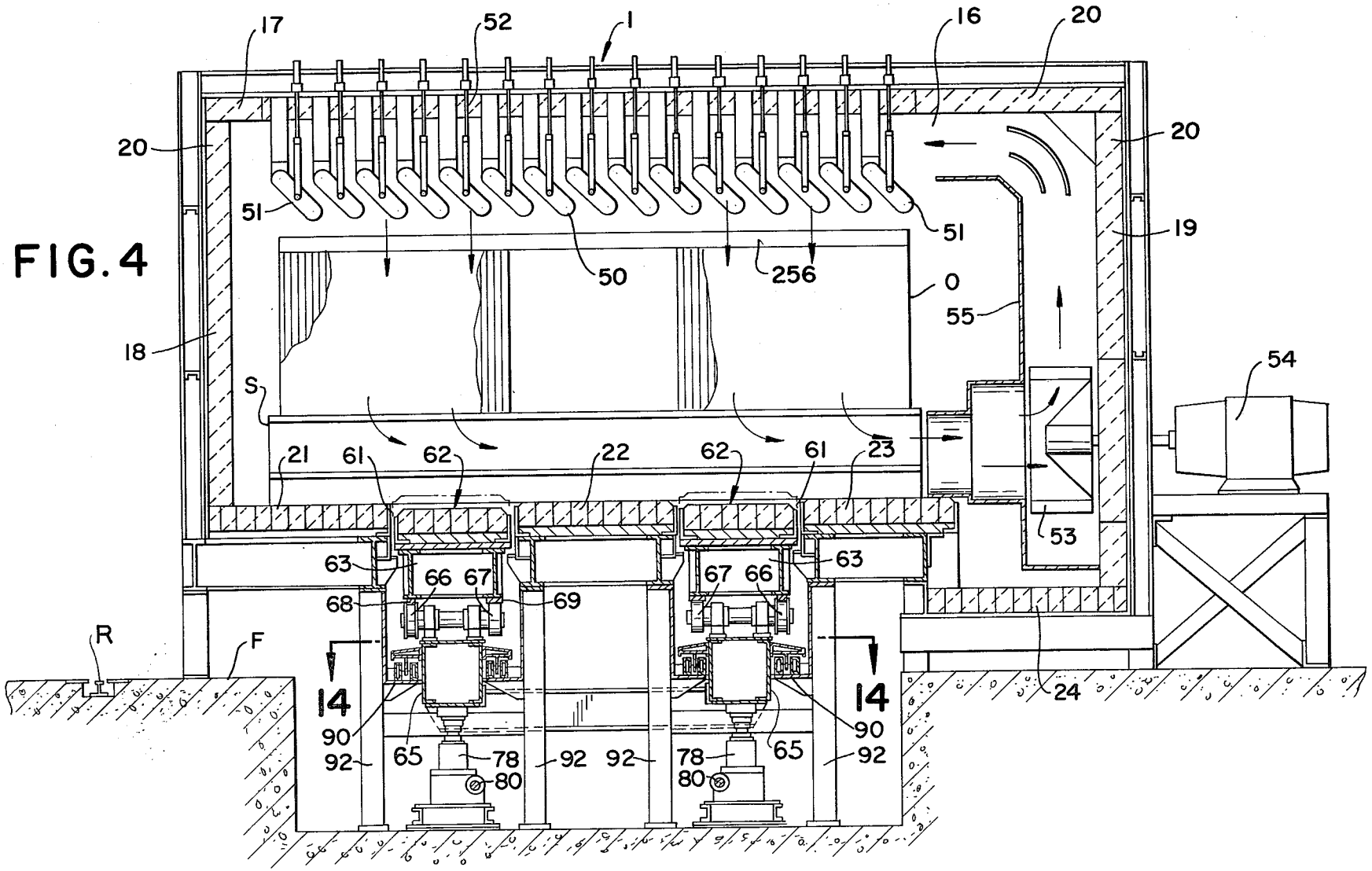
FIG. 4 is a section along line 4—4 of FIG. 2 but to a larger scale through one of the heating stations.
Figure 5:
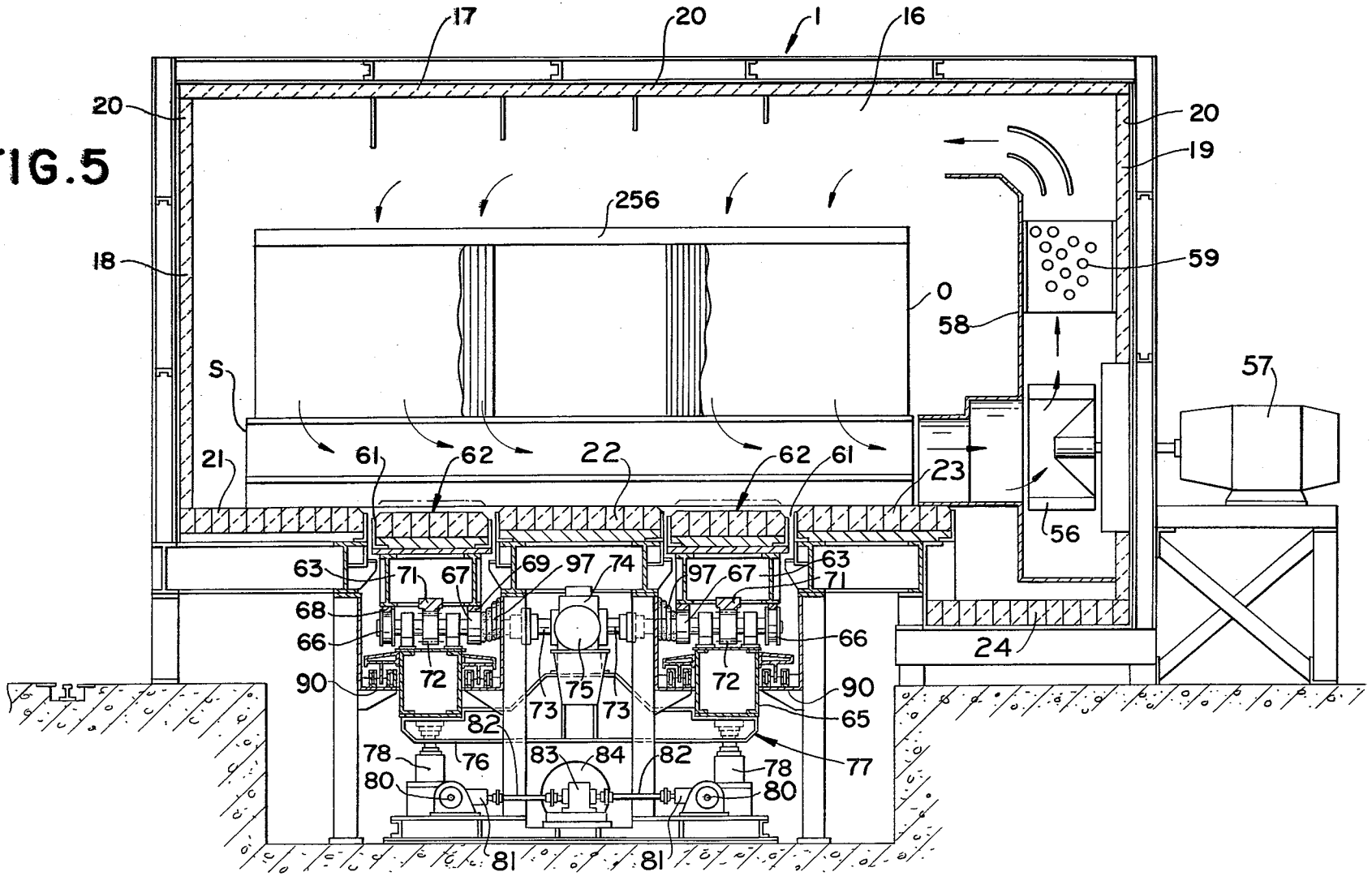
FIG. 5 is a section along line 5—5 of FIG. 3 to the FIG. 4 scale through one of the cooling stations.
Figures 6, 7:
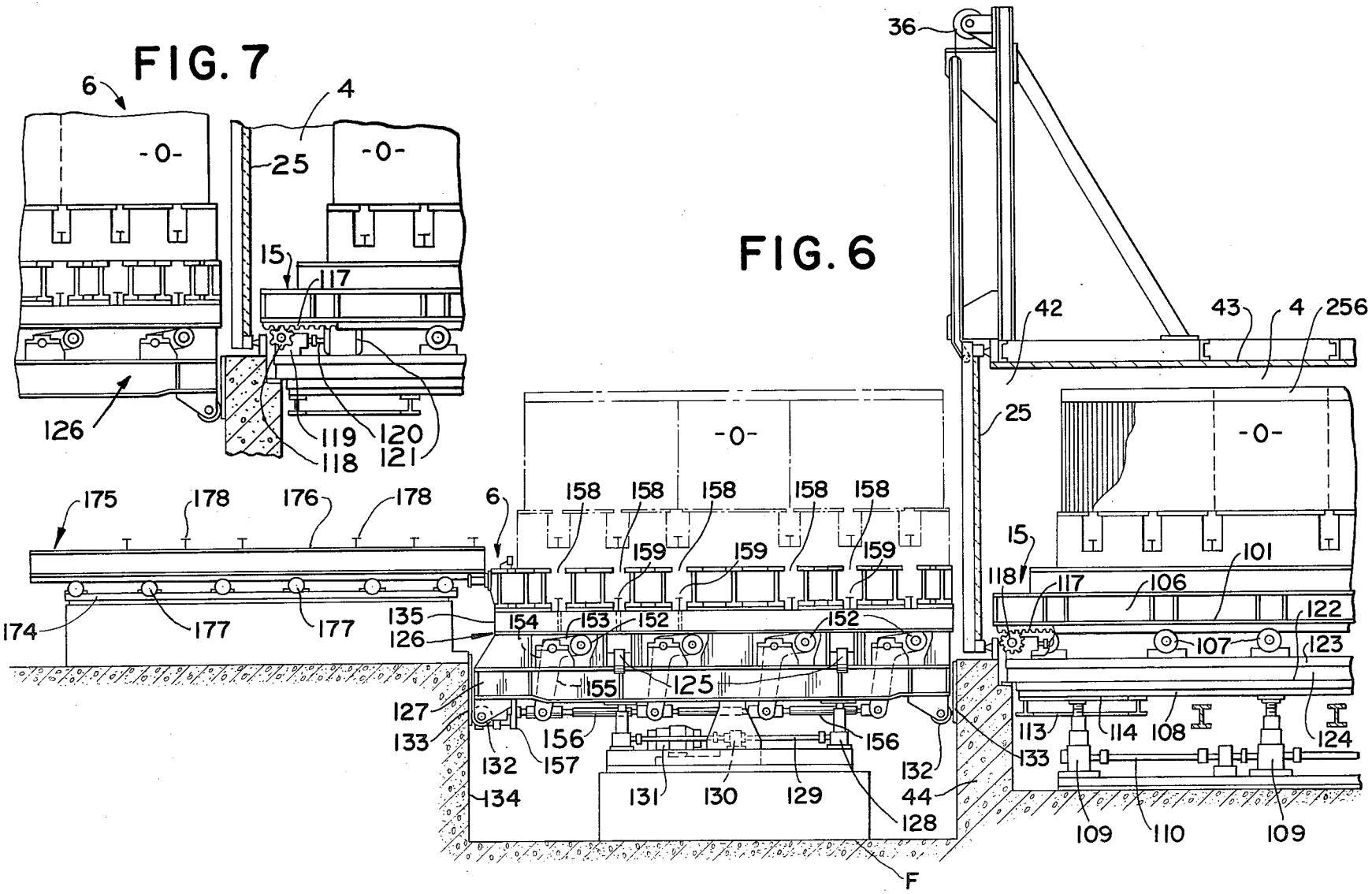
FIG. 6 is a side elevation, partially in section, of the left hand end portion of the apparatus showing a vertically movable loading platform, and a portion of the feed end purge chamber, to a scale larger than those of FIGS. 1-3.
FIG. 7 shows a portion of the auxiliary walking beam drive means of FIG. 6.

The furnace also includes (FIGS. 1, 2, 4) in each heating station of the heating zone 2, two banks 50 of radiant heating tubes 51 each tube being in the form of a flat narrow loop with parallel runs, the lower run of each of which loops is generally parallel and in close proximity to the upper end of the coil O when it is in the heating station. Each loop is positioned at an angle with its parallel runs offset as shown in FIG. 4 to facilitate flow of treating gas past both runs of each loop and thus effectively heat the gas. The tubes 51 are supported from the top of the furnace by hangers 52. Each tube is a combustion tube of known type, one end of which is connected to a burner, not shown, in which gas or liquid fuel is burned to provide hot gas which passes through the tube and heats it to provide radiant heat, the other end of the tube, not shown, discharging to a flue or to ambient atmosphere, and surrounding and spaced from an air supply tube to preheat air supplied to the burner, in known manner. Hot treating gas is passed to and through the loops of the heating tubes 51 of a bank and downwardly through the spaces between the spaced convolutions of the coil and through the coil support unit S, being circulated by a fan 53 driven by a motor 54 operating in an upwardly open housing 55 which properly directs the flow of gas to and through the tubes 51, the gas being returned from the bottom of the coil through the support unit S to the fan. There is such a fan and housing for each of the two banks of tubes for each coil at a heating station. Each bank of tubes, fan, and housing heats and moves the gas which passes through essentially one-half of the coil.

Similarly, at each cooling station (FIGS. 1, 3, 5) there are two fans 56 each driven by motor 57. Each fan drives and propels cooling gas, which may be the same gas as in zone 2 or an inert gas if desired, upwardly through an upwardly open housing 58 and between the coils of a known refrigerating unit 59, and then downwardly through the spaces between the convolutions of the open coil O at the cooling station, the gases passing out of the bottom of the coil and through the support unit S supporting the coil, and thence back to the fan. Each fan, housing and refrigerating unit supply cooling gas for essentially one half of the coil.

Known means are also provided to permit the supplying of a suitable inert or other gas, such as non-oxidizing gas or treating gas to the purge chamber 4 when both its doors are closed to replace atmospheric air in the purge chamber before door 26 is opened to permit the coil to enter the heating zone 2. Similarly known means are provided to permit the introduction of inert or other suitable gas such as the gas from the cooling zone into the purge chamber 5 when its doors are closed, to permit the replacement of atmospheric air before the door 28 is opened between the furnace enclosure 16 and the purge chamber.

Walking Beam Structure

The walking beam means 14 in the furnace comprises, in the illustrated embodiment, stationary work supporting portions 21, 22 and 23 the upper surfaces of which are in a common horizontal plane and which are transversely spaced to provide two parallel slots 61 extending for the full length of the furnace enclosure 16. Two parallel movable walking beams 62 are located in the slots 61.

Each beam 62 is made up of sections 62*a* to 62*e* inclusive (FIGS. 2,3) connected together at their ends. The sections of both beams 62 are moved vertically and horizontally in unison to simultaneously lift, to move horizontally, and deposit on the stationary members all of the coils in the furnace enclosure, to move each coil from one treating station to a succeeding treating station, as hereinafter described.

Each beam section comprises (FIGS. 2–10) an upper layer of heat resistant material of substantial structural strength such as fire brick, that is fixed to an elongated frame 63. Frames 63 for each beam 62 are connected together at their ends by joints 64 providing for limited pivotal and vertical relative movement to allow for slight irregularities in alignment.

The means making possible desired guided longitudinal movement of each beam frame 63 comprise pairs of rollers 66, 67 rotatably mounted about horizontal axes on a support member 65, one for each frame 63, the support member 65 for all frames of a beam 62 being moved vertically in unison, as described later. The rollers 66 at one side of support members 65 each have a grooved periphery with an axially flat bearing surface adapted to engage mating rails 68 on the undersides of frames 63 accurately to guide the beam sections during their longitudinal movements; the rollers 67 at the other side of support member 65 each have a cylindrical periphery adapted to roll on rails 69 fixed to the undersides of frames 63, to avoid any binding between these rollers and their rails from thermal dimensional changes.

Figures 8, 9:
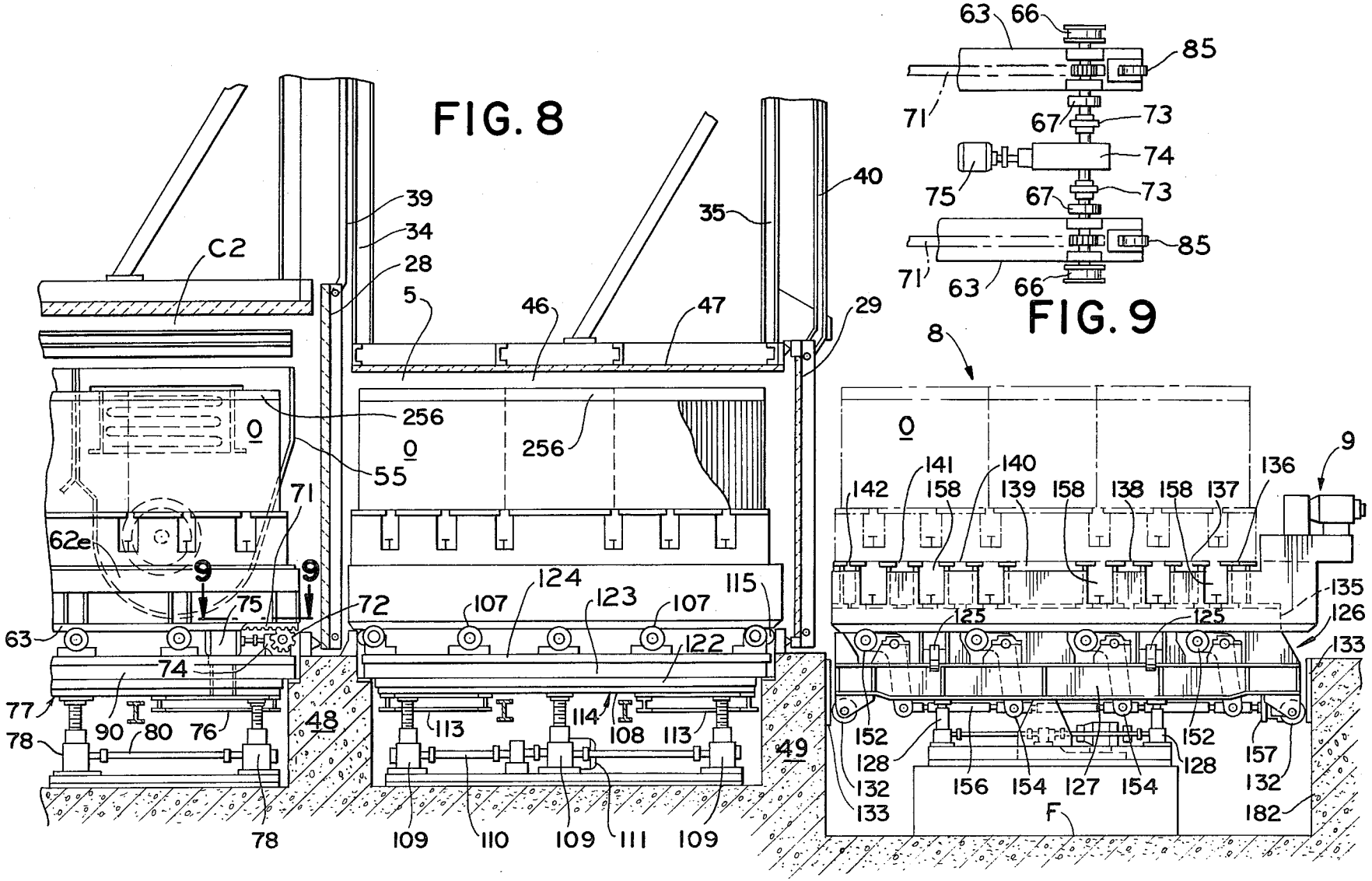
FIG. 8 is a sectional side elevation of the right hand end portion of the apparatus, showing a portion of the last furnace cooling stage, the discharge end purge chamber, and the unloading platform, to the scale of FIG. 6.
FIG. 9 is a diagrammatic plan of the drive mechanism for moving walking beams longitudinally.
Figure 13:
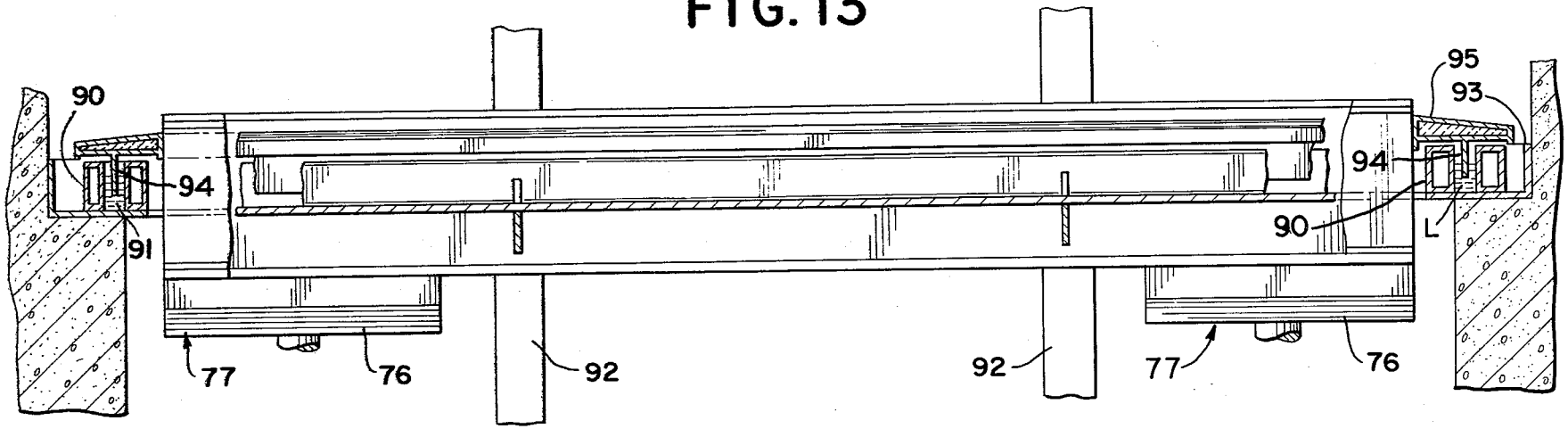
FIG. 13 is a section along line 13—13 of FIG. 12.
Figure 12:
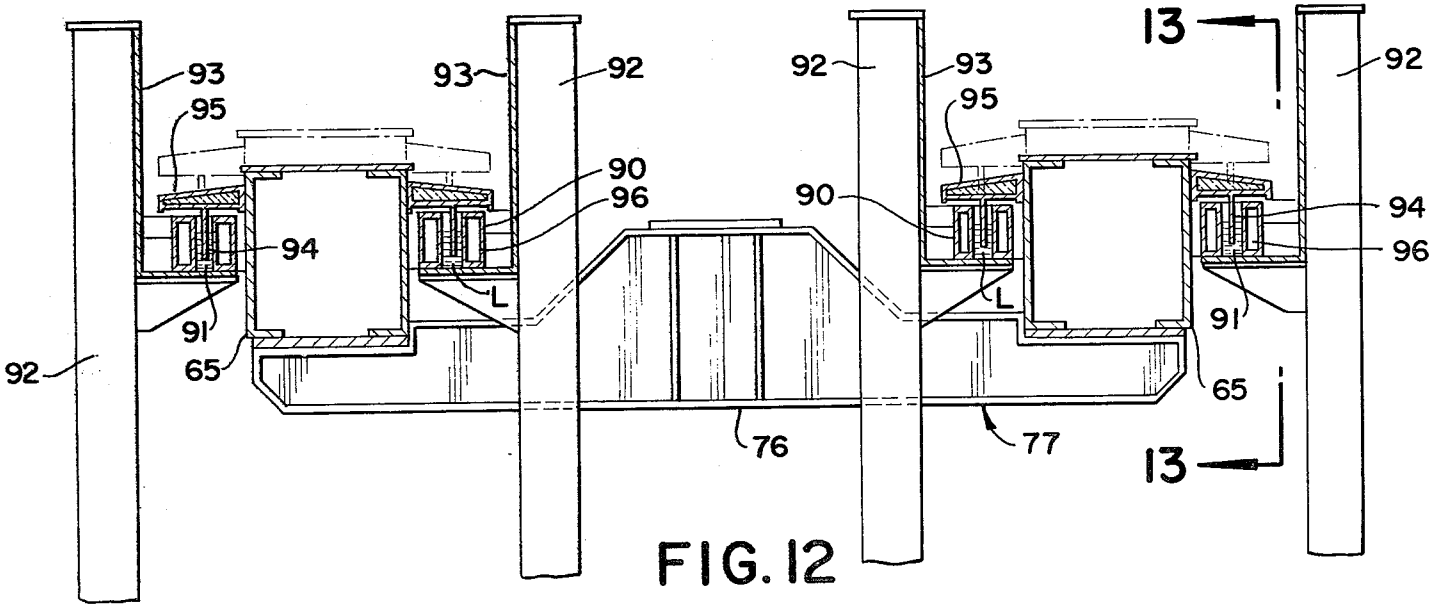
FIG. 12 is a cross section along line 12—12 of FIG. 14 showing the walking beams sealing means.
Figure 14:
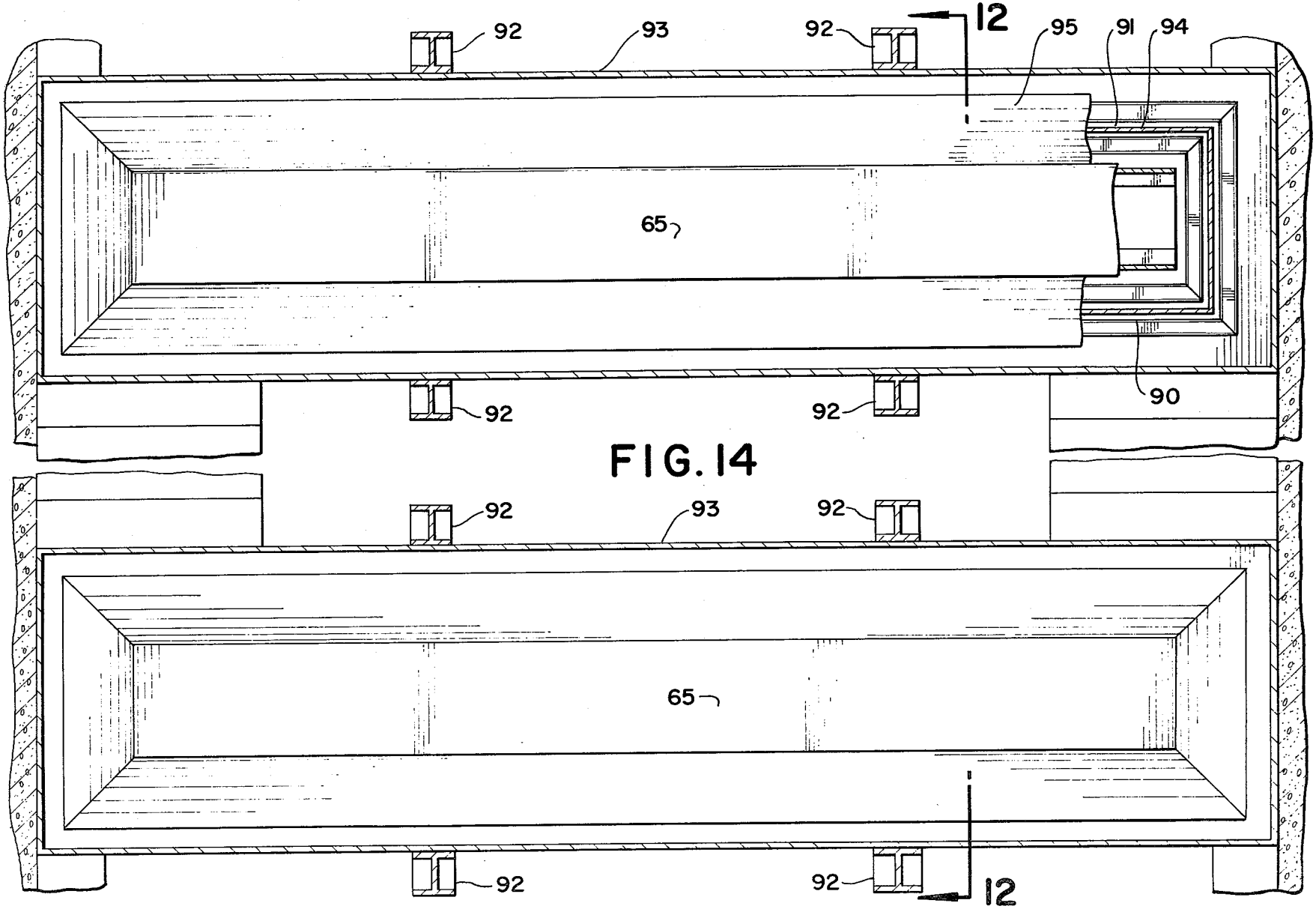
FIG. 14 is a plan section along line 14—14 of FIG. 4 of the sealing means for the walking beams.

All end connected frames 63 for each beam 62 are moved in unison longitudinally on support members 65, when required, by a rack 71 (FIGS. 3, 5, 8) which in the illustrated embodiment is fixed to the underside of one of the frames, the endmost frame nearest the discharge end of the furnace enclosure. The downwardly extending teeth of the rack are engaged by the teeth of a pinion 72 rotatably mounted on the associated vertically movable support member 65. The racks 71 for the two corresponding beams are located in corresponding positions, and the drive pinions 72 are mounted coaxially so that they can, as illustrated in FIGS. 8 and 9, be driven by coaxial shafts 73 from a gearbox 74 and motor 75 that are supported from the vertically movable structure embodying the endmost support members 65.

Figure 3:
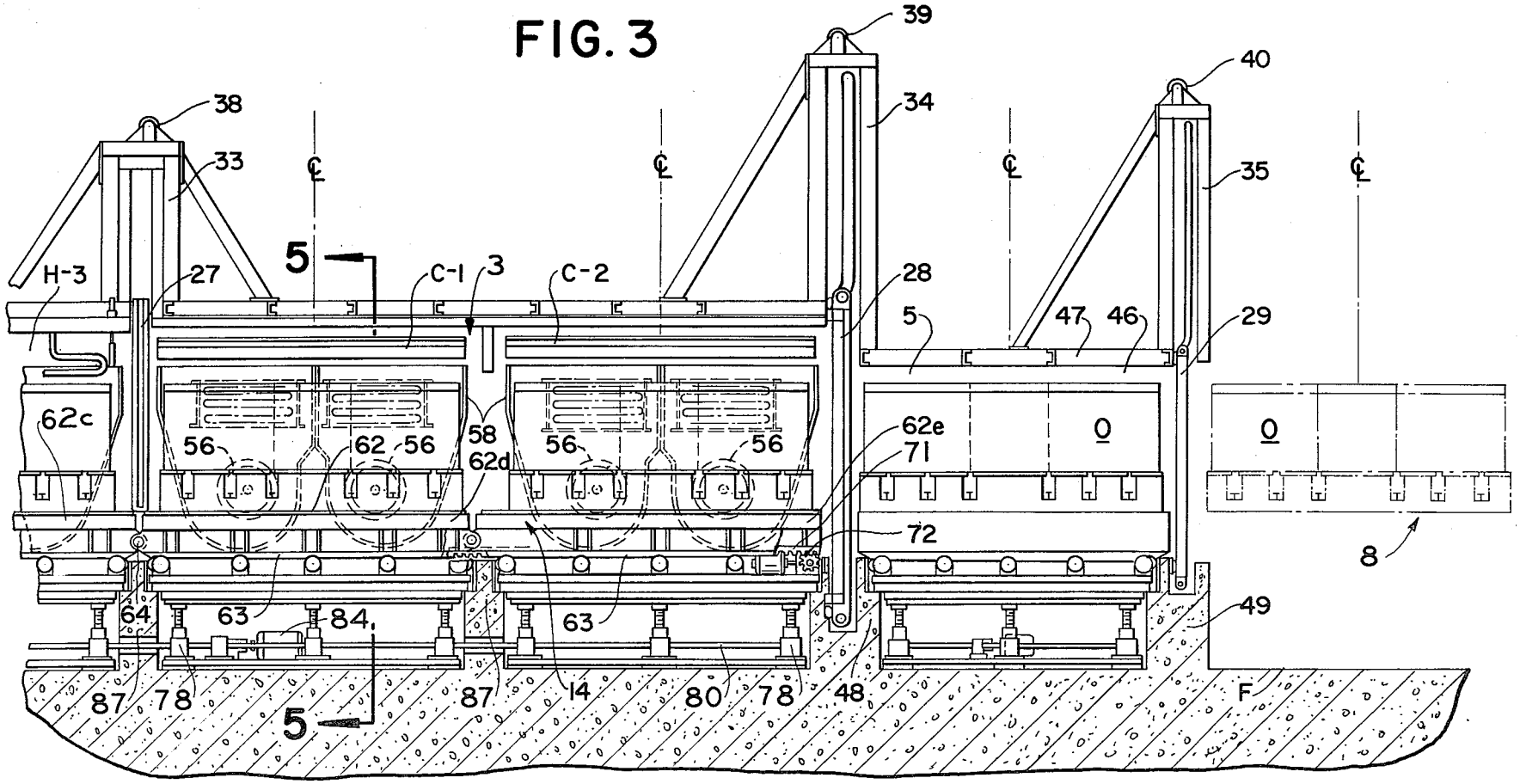
FIG. 3 is a side sectional view of the right hand end portion of the furnace enclosure and the discharge purge chamber of the apparatus of FIG. 1, to the scale of FIG. 2.

The racks 71 are of sufficient length to permit the beams 62, after their tops have been raised above the tops of the work supporting portions 21–23 so they lift the coils and their supports, to be moved in a walking stroke that lifts all coils and their support units on beams 62, and simultaneously moves each such coil and its unit S from one treating station H-1, H-2, H-3, or C-1, to the succeeding station, and from station C-2 into chamber 5; and then to retract the beams while their tops are below stationary supporting portions 21–23. Consequently, the racks are longer than the beam frames 63 (FIGS. 3,8).

Pairs of corresponding parallel support members 65 for pairs of corresponding parallel beams 62 are rigidly connected together by cross beams 76 (FIGS. 5–9, 12)

to form rigid structures 77, each embodying a pair of vertically movable support members 65 and a plurality of cross beams 76. All structures 77 are raised and lowered as required in unison by screw jacks 78, six of which are shown as supporting each structure, three jacks being connected to each support member 65. All screw jacks are driven in unison by a common drive means (FIGS. 2–11) embodying a shaft 80 interconnecting all jacks for one beam 62. The two shafts 80 are driven through gearboxes 81 and cross shafts 82 from a gearbox 83 driven by electric motor 84 (FIG. 11).

Each structure 77 embodying a pair of corresponding movable support members 65 is restrained (FIGS. 2, 3, 10) against movement longitudinally of the furnace by rollers 85, mounted at the ends of each such structure for rotation about horizontal axes which rollers bear against guide plates 86 mounted on upstanding wall portions 48 and 49 fixed to the floor at the ends of furnace enclosure 16, and on intermediate upstanding cross walls 87 fixed to the floor between the ends of structures 77. Structures 77 and their vertically movable support members 65 are restrained against lateral movement because of their rigidity and because of the jacks.

The illustrated furnace apparatus (FIGS. 2–6, 10, 12–14) embodies means 90 for completely sealing the walking beam portion of the apparatus against escape of gas from the interior of the furnace enclosure 16 downwardly past the walking beam apparatus, so that when the end doors 26 and 28 of the furnace enclosure are closed the furnace enclosure is entirely sealed against escape of treating gas or entrance of ambient air.

The sealing means comprises a trough 91 that is separated from but extends completely around each of the supports 65 of each pair of supports in each rigid structure 77, each trough being supported adjacent the ends of the support members 65 by the upstanding wall portions fixed to the floor above which the furnace enclosure is mounted, and at the sides of each support member 65 from spaced supporting posts 92 that also support the stationary work supporting portions 21–23 of the furnace enclosure.

Moreover, each trough is connected gas-tight to a wall structure 93 that is supported by posts 92 and also connected in gas tight relation to the upstanding wall portions adjacent the ends of members 65.

Each support member 65 has rigidly fixed to it a downwardly extending gas impervious sealing flange 94 that extends completely entirely around the support member and into the trough 91 surrounding the support, the flange 94 being supported by a heat-insulated member 95 extending laterally around the member 65 and fixed to it gas tight.

Furthermore, enclosures 96 at the sides of troughs 91 are hollow to contain, or permit circulation therethrough, of cooling fluid or liquid. Each sealing trough contains a suitable liquid L that is maintained at a safe lower temperature by the cooling fluid or liquid in enclosures 96.

Moreover, flexible sealing means such as bellows 97 formed of suitable heat resistant flexible material surrounds each of the shafts 73 to prevent gas leakage along the shaft past the wall structure 93.

Consequently, each of the support member 65 that moves only in an upright path is completely sealed around its periphery against gas leakage, and the upper portion of each of these supports and its associated beam frame 63 for each beam 62 are located in an enclosure formed by the sealing trough and flange, the wall structure 93, and the upstanding wall portions, which enclosure communicates only with the interior of the furnace enclosure 16 through the spaces between the beams 62 and slots 61, and is gas tight at all times.

However, the drive motor 75 and gearbox 74 that move beams 62 longitudinally, and the drive mechanism and jacks that move the beam 62 vertically, are all exposed to ambient atmosphere where they are not subjected to excessive heat and where they are readily available for maintenance and repair.

Auxiliary Walking Beam Apparatus at Loading End

The auxiliary walking beam means 15 (FIGS. 1, 2, 6, 7) comprises a pair of parallel walking beams 101 that are adapted to move between and be stationed at proper times, in loading station 6, in purge chamber 4, and in treating station H-1 of enclosure 16 of furnace 1, for reasons to be hereinafter described. The length of the stroke of such walking beams is such that the beams can lift a coil and its supporting unit S from loading station 6 and position it in purge chamber 4, and then in treating station H-1 of furnace 1, at a location such that the coil and supporting unit can later be picked up by the walking beams 62 and moved from treating station H-1 to the next treating station H-2, and thereafter to succeeding stations.

Purge chamber 4 has stationary work supporting portions 102, 103 and 104 (FIG. 1) separated by slots 105 that are equal in width and spacing to the slots 61 of the walking beam apparatus 14, in furnace enclosure 16.

The spaced parallel walking beams 101 are of the same transverse dimensions as walking beams 62 of furnace portion 16. Each beam 101 comprises a beam frame 106 that is similar to any of the beam frames 63 included in walking beam 62; these beam frames 106 are supported by rollers 107 which are similar to the rollers 66 and 67 supporting frames 63 of beams 62, in that those on one side are grooved to engage and guide a guide rail on the bottom of each frame 106 and those on the other side are cylindrical and engage another rail on frame 106. These rollers are rotatably supported by a support member 108, one for each beam frame 106.

Members 108 are adapted to be raised and lowered, in a vertical path only, by screw jacks 109 operated, through drive means 110 similar to that previously described, from power source 111. The two support members 108 are rigidly connected by cross members 113 to form a rigid structure 114. Structure 114 (FIG. 2) is restricted against longitudinal and transverse movement and guided solely in vertical movement, by rollers 115 on structure 114 that engage vertical plates 116 fixed to the wall portions at the ends of the purge chamber 4, and by jacks 109.

Beams 101 are moved longitudinally thereof as required by racks 117, one of which is fixed to the bottom of beam frame 106 and extends throughout and beyond the length of each frame. Each of these racks is engaged by either of pinions 118 (FIGS. 6, 7) at each end of each beam support member 108 the corresponding pinions at each end of such support member being driven by suitable shafts and a gearbox 119 through suitable one-way clutch 120 from a motor 121 on structure 114 that drives the pinions for both beams at one end of members 108, so that each rack will be engaged all of the time by one or the other of the pinions 118 at the ends of one of members 108, when the beams 101 are moved into chamber 4 and also into loading station 6.

The auxiliary walking beam apparatus also includes second liquid sealing means 122, identical to sealing means 90 in the furnace enclosure, for preventing gas leakage past the walking beams between the interior of the purge chamber and the atmosphere. The sealing means comprises a flange 123 fixed gas-tight to vertically movable structure 114 and a liquid container trough 124 fixed gas tight to wall portions of the purge chamber.

Loading Station

Loading station 6 comprises a generally rigid platform 126 comprising a rigid frame 127 supported by four jacks 128 from floor F for movement in only a vertical path. The jacks are operated in unison from shafts 129 through gearboxes 130 from a motor 131. Platform 126 is restricted against movement longitudinally thereof by rollers 132 on frame 127 engaging guide plates 133 on upstanding wall portions 44 and 134, and is prevented from transverse movement by rollers 125 on frame 127.

Figure 15:
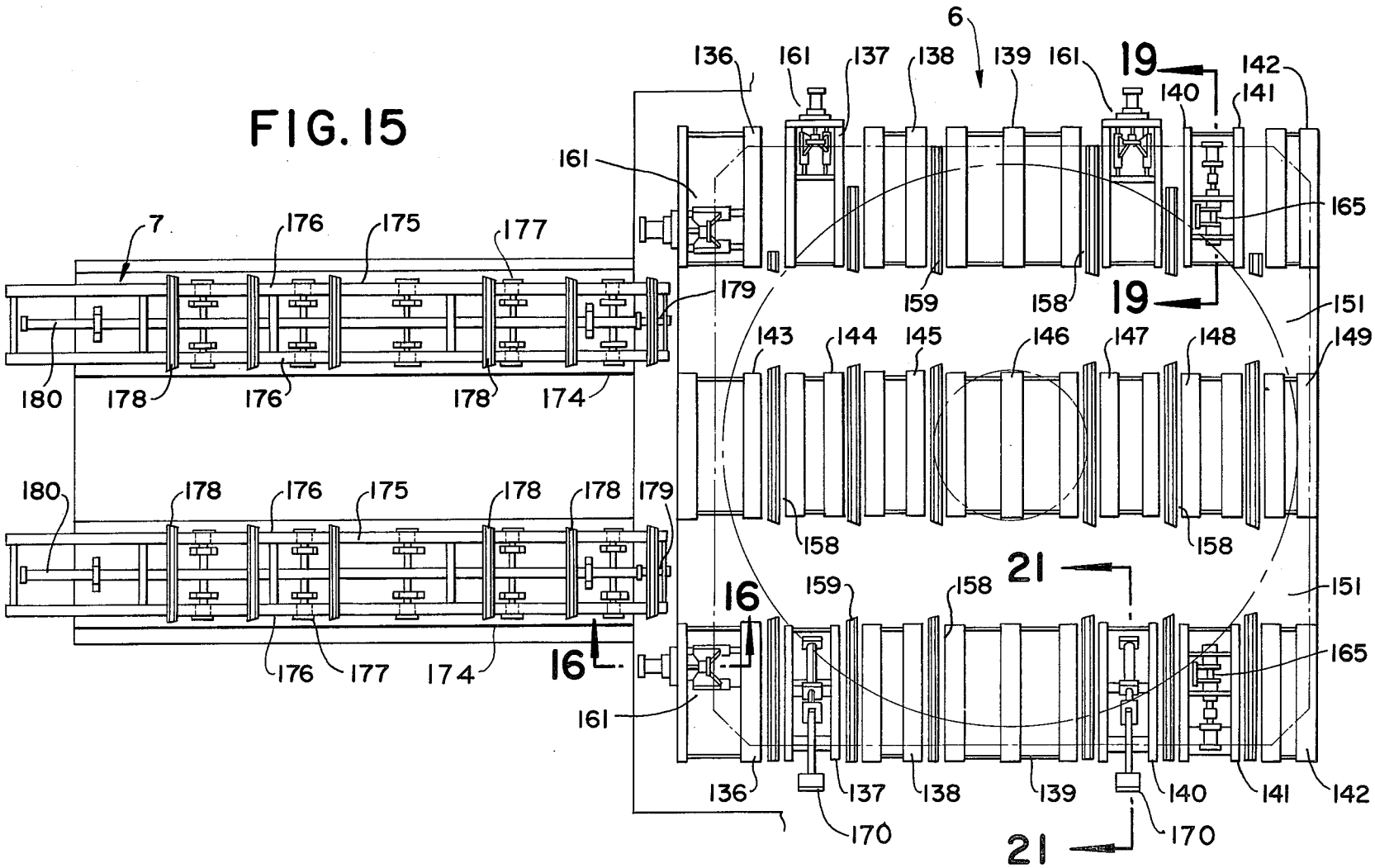
FIG. 15 is a plan showing the loading station, the rail filler means, and means for accurately locating a coil support unit on the loading platform.

Platform 126 includes an upper frame 135 rigidly fixed to platform 126 and rigidly carrying longitudinally and transversely spaced work-supporting portions 136–142 and 143–149 (FIG. 15). These portions are transversely spaced so that they define spaced longitudinally extending parallel slots 151 of the same width as slots 61 of walking beam apparatus 14, adapted to have inserted into them walking beams 101 of the auxiliary walking beam apparatus 15 when the beams are moved into the loading station.

Frame 127 of platform 126 carries pairs of coaxially mounted rollers 152 that are adapted to be raised to engage the underside of walking beams 101 when they are inserted into the slots 151. One roller of each pair has a grooved periphery like rollers 66 previously described engage and guide a guide rail on the bottom of each of beams 101 to insure that it does not move transversely of the platform 126.

Rollers 152 are raised as required to engage and lift the tops of walking beams 101 above the tops of the work-supporting portions of platform 126 and lower the tops of the beams below the tops of such portions. The rollers are supported on the ends of the short arms 153 of bell crank levers 154 which are pivotally mounted about fixed axes on frame 127 of platform 126; the lower longer arms 155 of the levers are pivotally connected to actuating shafts 156 adapted to be moved longitudinally by fluid cylinder 157 to raise and lower the rollers 152 as required.

The work supporting portions of platform 126 are also longitudinally spaced to define spaced slots 158 extending completely transversely of the loading platform. Each of slots 158 has rail portions 159 adapted to have roll on them the rollers of the work lifting and supporting bars 11, to be described later, of the transfer car T after the gaps in the rails in slots 158 have been closed by matching rail portions of the filler beam means 7.

The loading station 6 also includes means for accurately locating a support unit S on the upper surfaces of the work supporting portions of loading platform 126. Such means (FIGS. 15–18) include a pair of adjustable stop means 161 fixed to one end of platform 126, and a pair of such means 161 fixed to the far side of platform 126 remote from rails R. Each means 161 includes two parallel shafts 162 fixed to the platform, a stop member 163 slidably movable on the shafts, and a fluid actuating cylinder 164 the piston rod of which is connected to the stop member for adjustable positioning.

Figure 21:
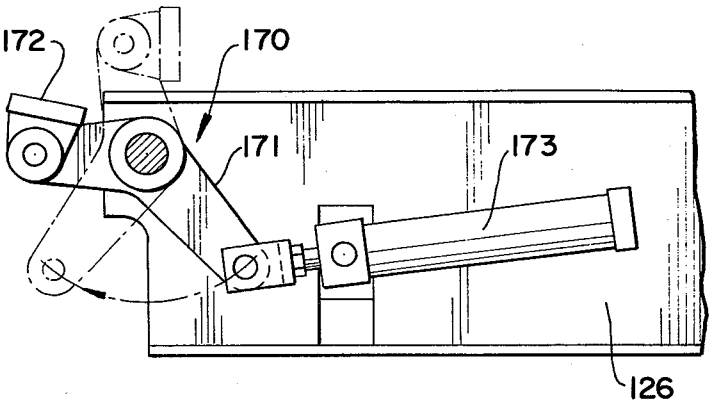
FIG. 21 is a section along lines 21—21 of FIG. 15 of another type of pushing means.
Figure 19:
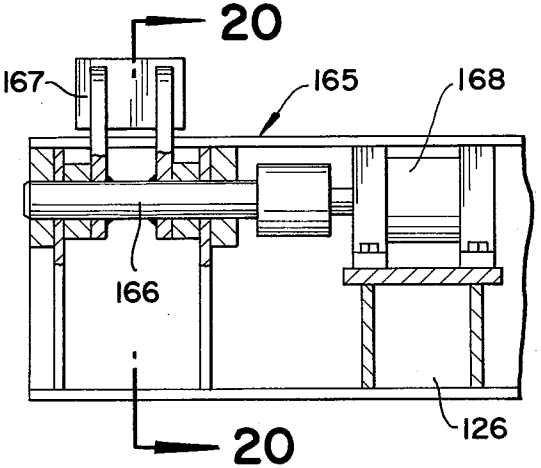
FIG. 19 is a section along lines 19—19 of FIGS. 15 and 20 showing means for pushing the coil support unit against stop means on the loading platform.
Figure 20:
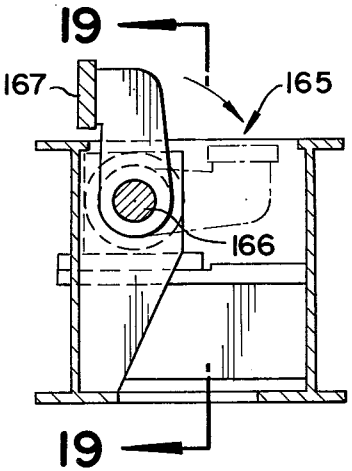
FIG. 20 is a section along line 20—20 of FIG. 19.
Figure 18:
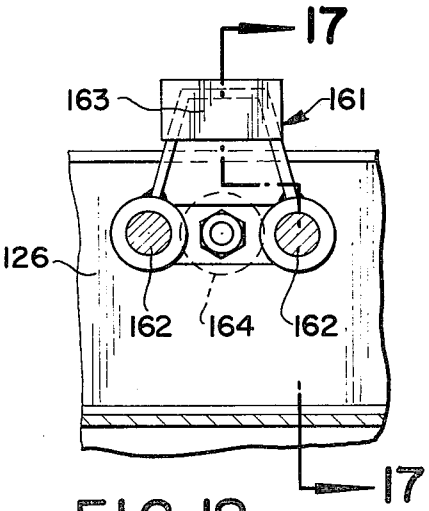
FIG. 18 is a section along line 18—18 of FIG. 16.
Figure 17:
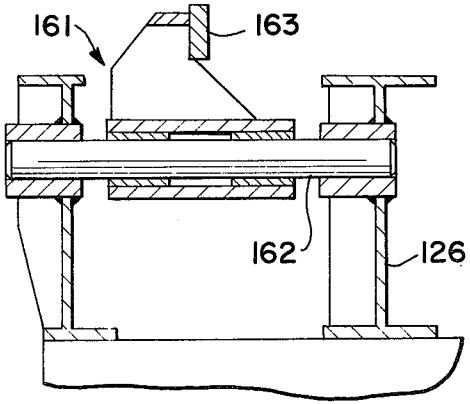
FIG. 17 is a section along line 17—17 of FIG. 18.
Figure 16:
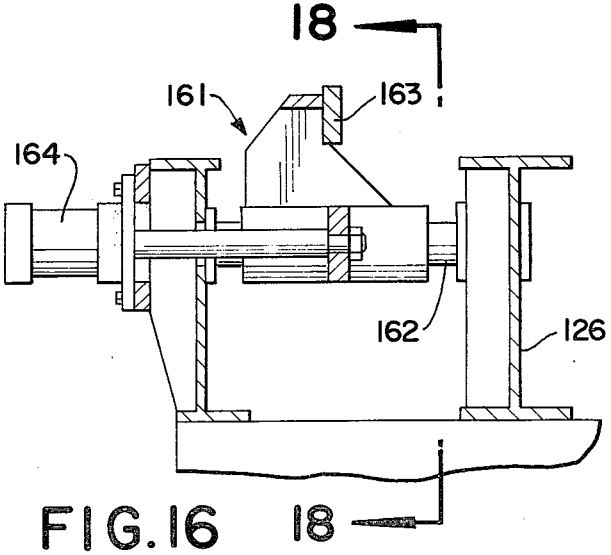
FIG. 16 is a section along line 16—16 of FIG. 15 of one of the adjustable stop means for accurate location of the coil support unit on the loading platform.
Figures 22, 23:
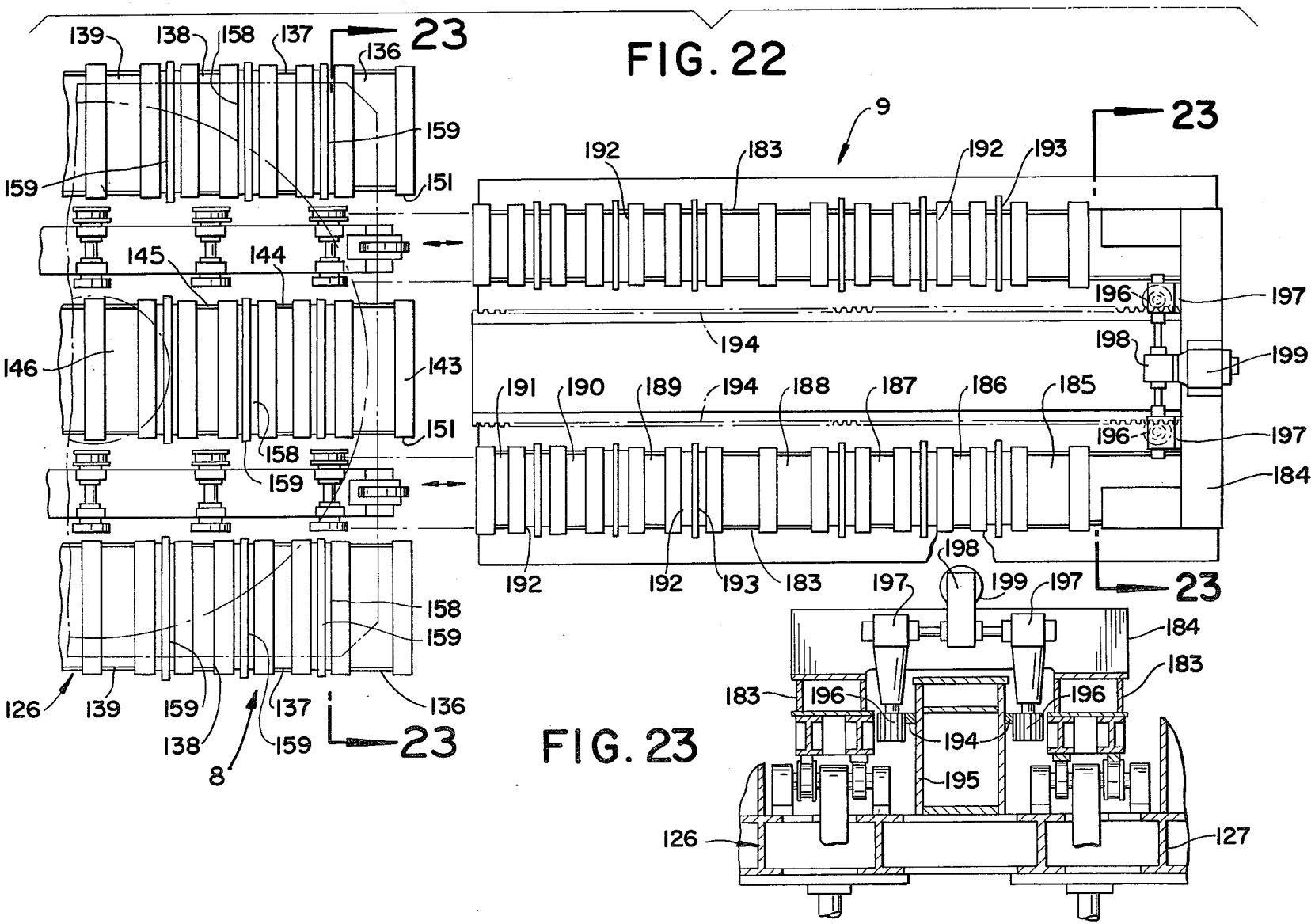
FIG. 22 is a plan view of the unloading end of the unloading station, with the unloading platform and transfer beam means shown completely separated for convenience in disclosure, although the traveler beam means normally is wholly in the unloading platform or partly in the unloading end platform and partly in the unloading end purge chamber.
FIG. 23 is a section showing the transfer beam means in the unloading platform and particularly showing the drive mechanism for the transfer beam means, the section corresponding to line 23—23 of each of the parts of FIG. 22.

Platform 126 also includes means for pushing the support unit S against the stop means after the unit has been placed on the platform 126. A pair of pushing means 165 (FIGS. 15, 19, 20) are mounted near one end of the platform to push support unit S longitudinally of the platform against the stop means 161 at the other end of the platform. Each means 165 fits in a work supporting portion of the platform and comprises a shaft 166 rotatably mounted in such portion and rigidly carrying a pusher portion 167 that can move from a position below the work supporting surface of the platform to an engaging position above such surface, being thus moved by rotation of the shaft by fluid motor 168. A pair of pushing means 170 (FIGS. 15, 21) are also located at the near side of the platform for pushing the unit transversely of the platform against the stop means at the far side of the platform. Each comprises a lever 171 pivotally mounted on platform 126 and having one end constituting a pusher portion 172 and the other end connected to fluid actuated cylinder 173 pivotally mounted on the platform.

The filler beam means 7 (FIGS. 6, 15) for the loading station 6 comprises a base 174 supporting for horizontal longitudinal movement two rail filler elements 175, each comprising two rigidly interconnected spaced parallel frame members 176 the lower surfaces of which are adapted to roll on and be guided by rollers 177 rotatably mounted on the base 174 and rollers 152 of the loading station. The upper edges of frame members 176 rigidly carry rail filler portions 178. Frame members 176 are adapted to be moved longitudinally into the slots 151 of the loading platform to carry the rail filler portions 178 into matching engagement with rail portions 159 on the loading platform and thus provide a plurality of spaced parallel continuous rails on which can ride the rollers of the transfer car the frame members of lifting and supporting bars. It should be noted that the ends of the various portions are cut at an angle, and that the lengths of the rail filler portions 178 increase as the rail filler portions penetrate slots 158, so as to form a tight fit by bearing against the correspondingly cut and shaped end of the rail portions 159 fixed to and on the loading platform.

The rail filler elements 175 are moved into and out of the slots 151 of the loading platform 126 by piston rods 179 fixed to elements 175 and connected to pistons in cylinders 180 fixed to base 174.

Walking Beam Apparatus for Unloading End Purge Chamber and Unloading Station

Purge chamber 5 (FIGS. 1, 3, 8) is similar to purge chamber 4 in that it contains stationary work supporting portions 102, 103, and 104 separated by slots 105 which are equal in width and spacing to the slots 61 of the walking beam apparatus in furnace enclosure 16. The side walls of chamber 5 are connected gas tight to portions 102 and 103.

Purge chamber 5 also contains lifting portions of a walking beam apparatus that are similar to that in the purge chamber 4, comprising a pair of spaced parallel support members 108 similar to support members 65 of walking beam 62 which are connected together by cross members 113 to form a rigid structure 114. This rigid structure 114 is adapted to be raised and lowered as required by lifting jacks 109 three of which bear against the bottom of each support member 108 all six lifting jacks being raised and lowered in unison by a common drive means 110 from a power source such as motor 111. The support member 108 each carry pairs of spaced rollers 107, those on one side of each support member 108 having grooved peripheries to guide a walking beam to be later described, and those on the other side having cylindrical peripheries.

The apparatus in chamber 5 also includes a liquid sealing means 122 comprising a flange 123 fixed gas tight to each support member 108 and a liquid containing trough 124 into which the flange extends and which surrounds each support 108 and is fixed gas tight to gas impervious walls, as previously described. Such sealing means prevents leakage of gas past the walking beams.

A portion of the apparatus in unloading station 8 (FIGS. 1, 3, 8) is similar to that in the loading station 6, in that it comprises a platform 26 comprising a rigid frame 127 that is movable only in a vertical path by four lifting jacks 128 supported from floor F. Frame 127 rigidly supports an upper rigid frame 135 rigidly supporting upwardly projecting spaced work supporting portions 136–142 and 143–149 corresponding to the identically numbered portions of the loading station platform 126, the tops of these portions lying in a common horizontal plane. These work supporting portions are spaced to define spaced, parallel transversely extending slots 158 having rail portions 159 adapted as hereinafter described to support the rolls of the lifting bars of the transfer car T. The work supporting portions also define spaced longitudinally extending parallel slots 151 of the same width as the parallel slots 61 of the walking beam apparatus 14 in furnace enclosure 16.

Frame 127 pivotally supports about fixed axes bell crank levers 154 the short arms of which carry pairs of rollers 152 one of each which pairs is grooved as previously described and the other of which has a cylindrical periphery, and the lower ends of the longer arms of the bell crank levers being connected to a shaft 156 that is adapted to be moved longitudinally by fluid cylinder 157 and thus raise or lower the rollers as required.

Platform 126 of the unloading station is guided along a vertical path and restrained against longitudinal movement by rollers 132 on the ends of frame 127 engaging guide plates 133 on upstanding wall portions 48 and 182, and by the rollers 125 on frame 127.

The transfer beam means 9 at station 8 (FIGS. 1, 8, 22, 23) comprises two elongated generally horizontally extending members 183 rigidly connected to a cross member 184. The tops of members 183 rigidly carry spaced work supporting portions 185 to 191 inclusive adapted to fit in longitudinal slots 151 of unloading station platform 126, and define slots 192 adapted to complete slots 158 of such platform when members 183 are preferably longitudinally aligned with platform 126. Rail portions 193 are rigidly mounted on members 183 in slots 192, which rail portions are adapted to match and continue rail portions 159 in the slots 158 of the platform 126 when the beam members 183 are inserted into the slots 151 of the unloading platform 126 and are properly aligned longitudinally and vertically relatively to platform 126.

Members 183 also are dimensioned so they can be inserted into the slots 105 between the stationary portions 102 to 104 in purge chamber 5.

The means for moving the structure 9 generally horizontally comprises racks 194 fixed to both sides of a longitudinally extending raised central portion 195 supported from lower frame 127 of unloading platform 126, the top of portion 195 and the racks 194 being below the bottoms of transverse slots 158 in platform 126, to avoid interference with the rail portions 159 in platform 126 and filler rail portions 193 on transfer beam means 9, and the slots in which these rail portions are located. These racks are engaged by pinions 196 that are driven in unison through gearboxes 197, 198 from a motor 199 mounted on cross member 184 of the structure 9. These pinions are of substantial length so that they will still engage the racks when the structure 9 is moved to different elevations for operating purposes.

By this means the structure 9 can be moved as its members 183 extend into the slots 105 between the stationary work supporting portions 102–104 in purge chamber 5 while at a level below the top of such stationary portions, and then be raised by structure 114 to lift off a coil and its support unit S from such statonary portions and move them out of the purge chamber while the top of structure 9 is above the tops of the laterally immovable work-supporting portions of the purge chamber 5 and unloading platform 126, and then deposit them on such unloading platform from which the coil and its support S can be removed by the supporting bars 11 of the transfer car T as previously indicated.

Support Unit

As indicated above, as each coil travels through the apparatus it is supported on its individual associated support unit S, on which the coil is placed at the loading station, which travels with the coil through the furnace, and from which the coil is removed at the unloading station.

While in the furnace, as indicated above, each unit S not only supports the coil but also makes possible passage of treating gas through the coil.

Figure 24:
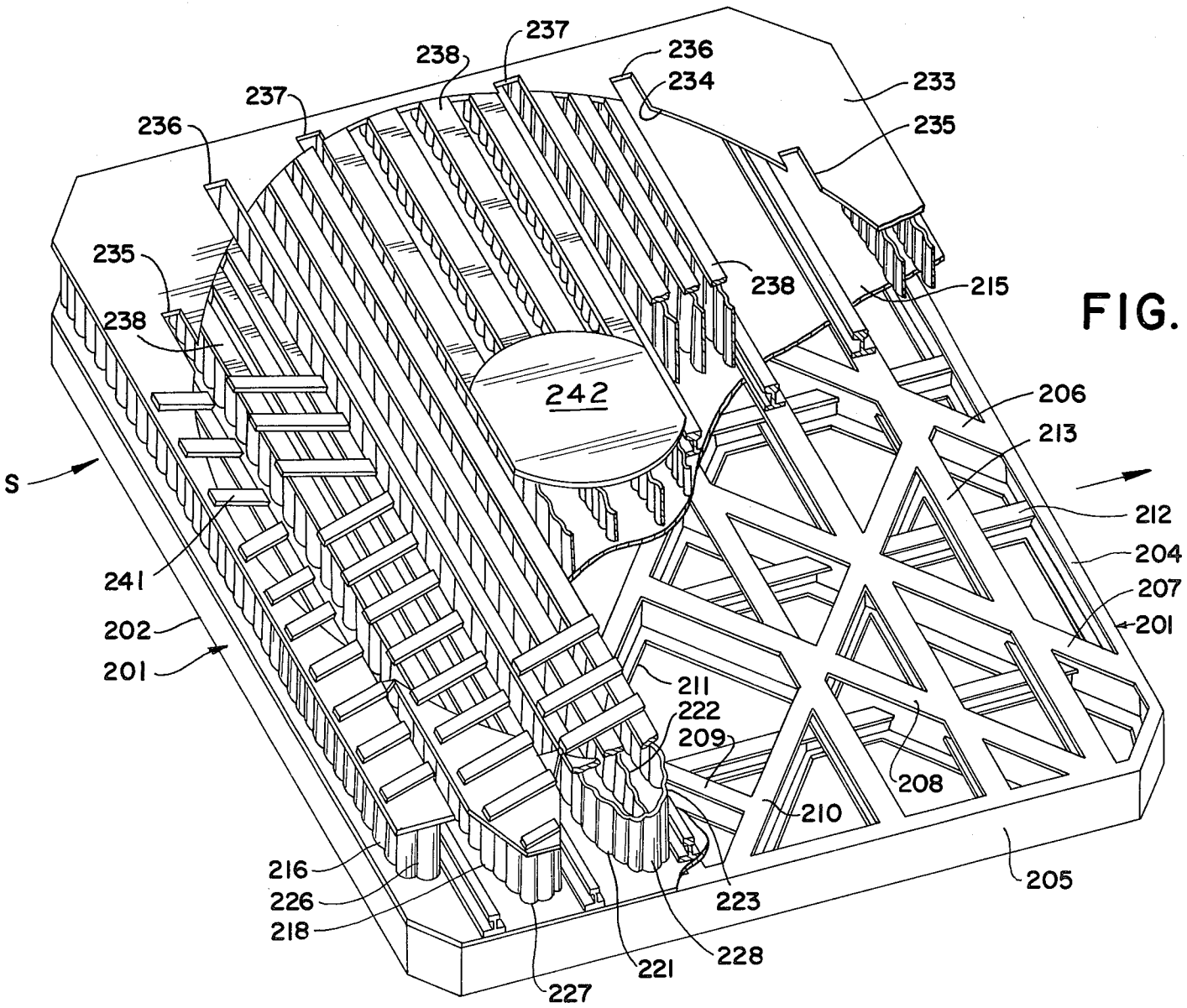
FIG. 24 is a perspective of one of the coil support units for supporting and accompanying the coil while it is moved through the furnace, parts being broken away.
Figure 27:
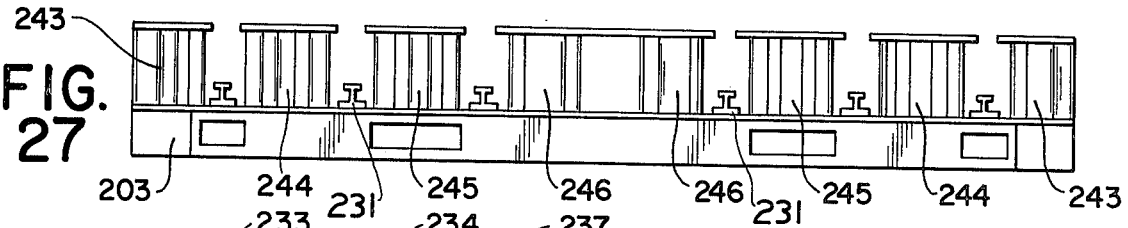
FIG. 27 is a view from line 27—27 of FIG. 25 of the rear side of the unit, showing openings for gas circulation.
Figure 25:
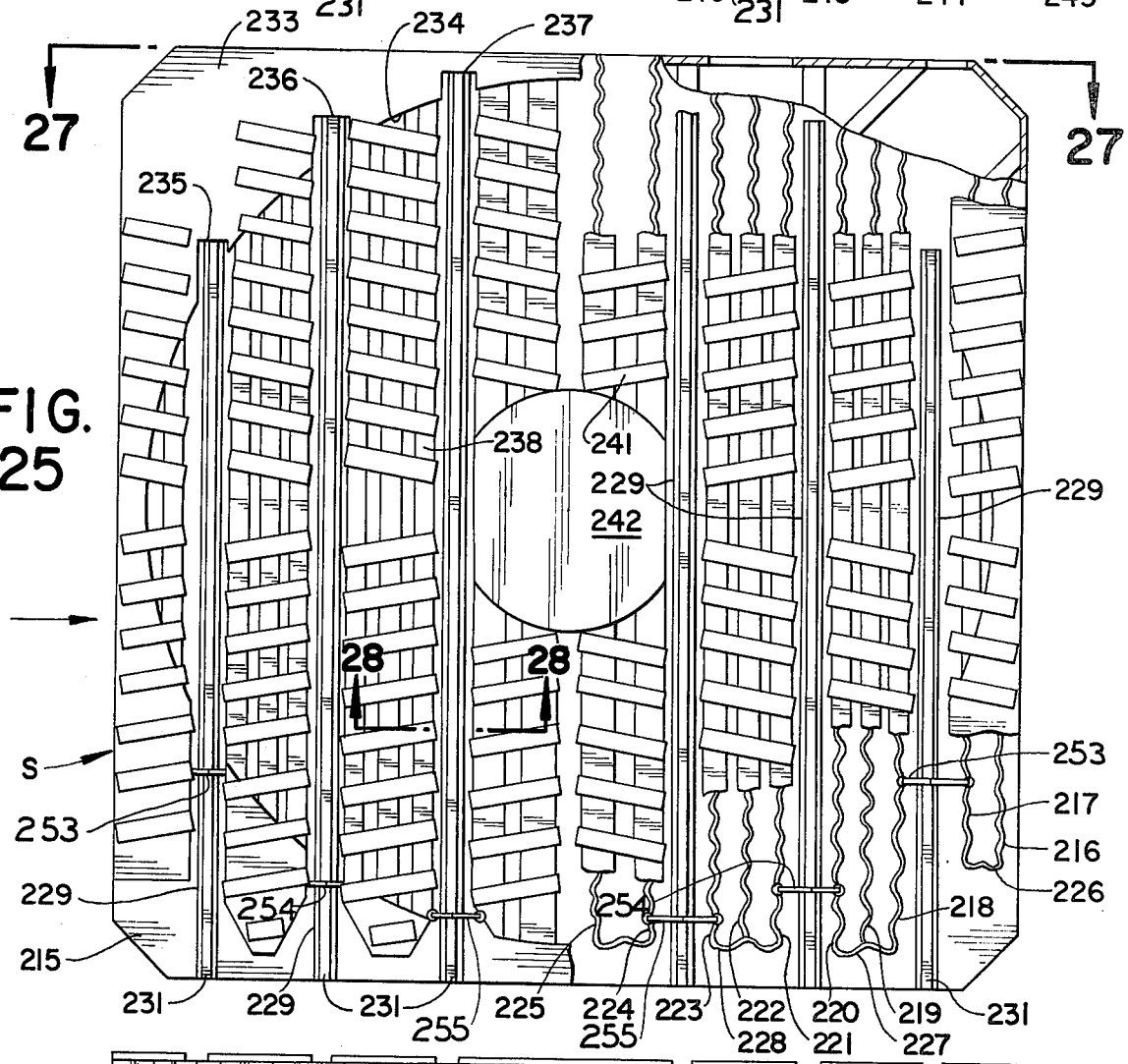
FIG. 25 is a plan of the unit of FIG. 24.

As shown in FIGS. 24–28, each unit S which travels through the furnace in the direction indicated by arrows in FIGS. 24 and 25, comprises a rigid lower frame 201 of generally square configurations made of outside beams 202, 203, 204 and 205 deep diagonal beams 206–211, lower cross beams 212 between the end beams 202 and 204 and upper cross beams 213 between side beams 203 and 205 the upper surfaces of beams 213 lying in the same plane as those of the diagonal and outside beams, to provide strong support. On these upper surfaces is rigidly fixed, in gas tight relation, a thick flat gas-impervious plate 215. This plate carries upwardly extending corrugated thick sheet steel wall members 216–225 that extend substantially completely across the width of the unit S, that is, transversely to its direction of movement through the furnace, and define passages between the wall members. The ends of the passages between certain wall members are closed at 226–228, while others are open to define slots 229 in which are located lengths of rails 231 that are fixed to plate 215; these rails being spaced and located so as to support the rollers of the lifting and supporting bars 11 of the transfer car T.

Fixed to the upper ends of the corrugated wall members is another plate 233 having a circular aperture 234 the diameter of which is slightly larger than the diameter of the coil to be supported, the portion of the aperture remote from the side of the support unit nearest the transfer car rails being slotted as shown at 235–237 to insure that the transfer car lifting and supporting bars fully contact the coil to its outer edges.

Within the aperture 234 the top edges of the corrugated wall members carry strip plates 238 top surfaces of which lie in the same plane as top plate 233.

Short transverse members 241 are fixed to plate 233 and strip plates 238 to provide the actual support for the coil, the lower edges of which rest on these members.

A central circular plate member 242 substantially of the diameter and area of the central opening of the coil is located in the central portion of the support unit S to prevent short circuiting of treating gas to the central portion of the coil.

Openings 243–246 at the side of the support remote from the side nearest the transfer car rails permit passage of gas between the exterior of the support unit and the spaces between the upstanding corrugated wall members. In the furnace, these openings are aligned with the gas inlet openings in housings 55 and 58 in communication with the fans 53 and 56 in the heating and cooling stations. Consequently, treating gas that passes upwardly through the housing and downwardly through the spaced convolutions of the coil in each of the heating and cooling stations in the furnace enclosure 16 passes into the spaces between the upstanding members of the support unit S for such coil, including spaces in which the rails 231 are located, then pass outwardly through the openings 243–246.

Figure 26:
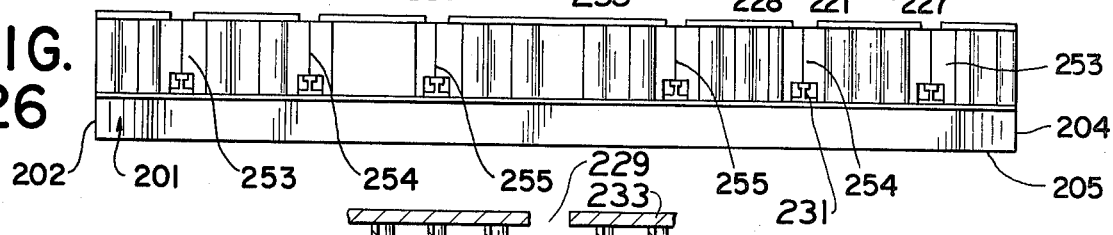
FIG. 26 is a view of the front side of the coil support unit, showing swinging doors closing the railed slots for the transfer car lift bars.
Figure 28:
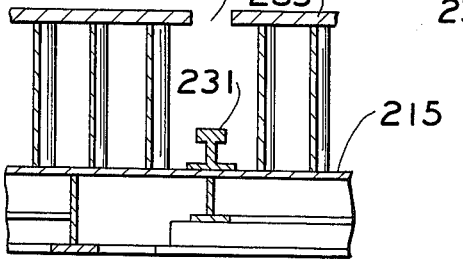
FIG. 28 is a section along line 28—28 of FIG. 25.

Preferably, as shown in FIGS. 25 and 26, pivotally mounted doors 253–255 are located at the entrance of the rail slots to permit the closing off of these slots to prevent short circuiting of treating gas. These doors can be manually actuated to close them after the coil support unit is properly located on the loading station platform, and can be manually actuated to open them when the coil and its support are deposited on the unloading station platform. Automatic door closing opening means can also be provided, such as weight means biasing the doors closed but allowing them to be pushed open by the transfer car bars when they are inserted into the rail slots in support S.

Preferably, a known removable heat shield 256 (FIGS. 2–6), disclosed and claimed in U.S. Pat. No. 3,904,356 dated Sept. 5, 1975, the disclosure of which is incorporated herein by reference, is located on top of each coil to protect the free upper edges of the spaced convolutions of the coil from distortion or deterioration due to heat radiated from the heating tubes 51. Such heat shield may be placed on the coil at the loading station by suitable means, such as an overhead crane.

Transfer Car

The transfer car T which is referred to above, may be of the type disclosed in U.S. Pat. Nos. 3,370,839 dated Feb. 27, 1968 or 3,446,491 dated May 27, 1969, and similar to that shown in FIGS. 29 to 31 inclusive. The car includes a main frame 261 having wheels 262 that ride on the rails. The wheels are power driven by motors 263 through suitable gearing, to positively move the car along rails R and locate it in the proper positions for loading and unloading coils or their support units.

Main frame 261 carries rails 264 on which ride the wheels 265 of an intermediate carriage 266 for movement in a path transversely to, and preferably at right angles to the path of travel of the main frame 261. Carriage 266 is moved in either direction on frame 261 by motor 267 on carriage 266 driving a pinion 268 engaging rack 269 on frame 261. Carriage 266 carries a platform structure 271 made up of parallel transversely extending rail supporting beams 272, six in number in the illustrated embodiment, each of which carries a rail 273. These beams 272 extend in a direction normal to the direction of travel of the car T on the rails R.

An upper carriage 274 comprises a wheeled frame 275 having six spaced parallel finger members 276. Each of these members 276 rotatably mounts a plurality of flanged wheels 277 that in turn are supported on one of rails 273 on a beam 272.

When the carriage 274 is extended to deposit or pick up a coil, or a support unit S, the wheels 277 also engage and are supported (FIGS. 30, 31) on the rails in the transverse slots in the loading station, or in the transverse slots in the unloading station, or in the transverse slots in a support unit S when a coil is to be deposited on or lifted off the unit, after such rails have been completed by the filler rails as previously described.

Each of the finger members 276 also supports a plurality of cam rollers 278 that are rotatably mounted between the wheels 277. The tops of rollers 278 are supported above the tops of the finger members and are adapted to engage and support one of six coil lifting and supporting bars 11 previously mentioned. Each of these bars has an upper coil engaging surface and is notched on its under side to provide a plurality of inclined cam surfaces 279 that are adapted to engage and co-act with the cam rollers to lift and lower the bars 11 as required to lift a coil or its support unit from a surface or to lower it onto a surface.

Bars 11 are connected together at their ends remote from the furnace apparatus to form an integral unitary forked structure 282 supported on cam rollers 278.

A vertical axis electric drive motor 283 mounted on the base portion of the wheeled frame 275 of the carriage 274 is connected through suitable gearing to drive a plurality of screw jack units 284 having threaded members 285 that are connected to forked structure 282 by vertically sloted connections. When motor 283 is actuated to cause the jacks to move threaded portions and hence forked structure 282 and its rollers 278 to the right, as seen in FIGS. 30–31, relative to the wheeled frame 275, the movement will take place between the frame 275 and bars 11 and cause the bars 11 to be raised as in FIGS. 29 and 30 in an upper coil supporting position, or lowered as in FIG. 31 to a lower coil discharging position.

Figure 30:
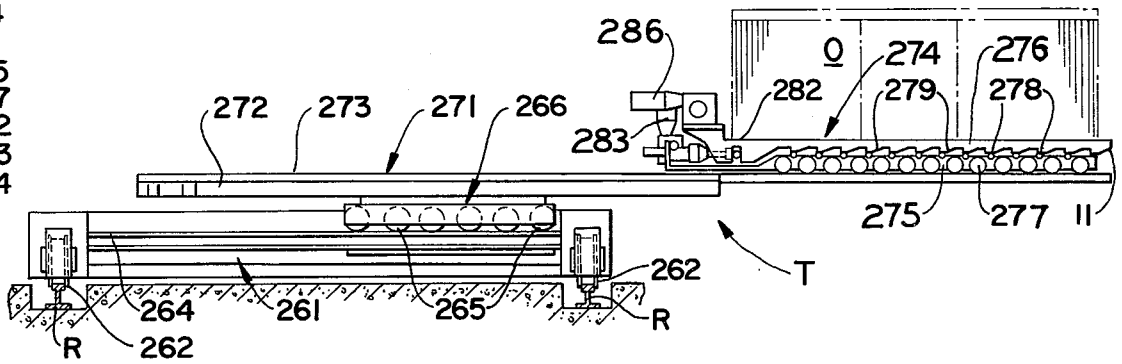
FIG. 30 is a side elevation of the car, the lifting bars being extended and raised to support a coil.
Figure 29:
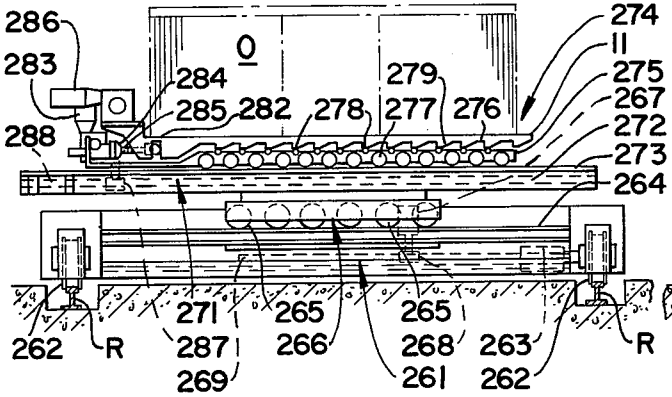
FIG. 29 is a side elevation of a transfer car for loading, moving and unloading coils and their supporting units, the lifting bars being retracted but raised to support a coil.
Figure 31:
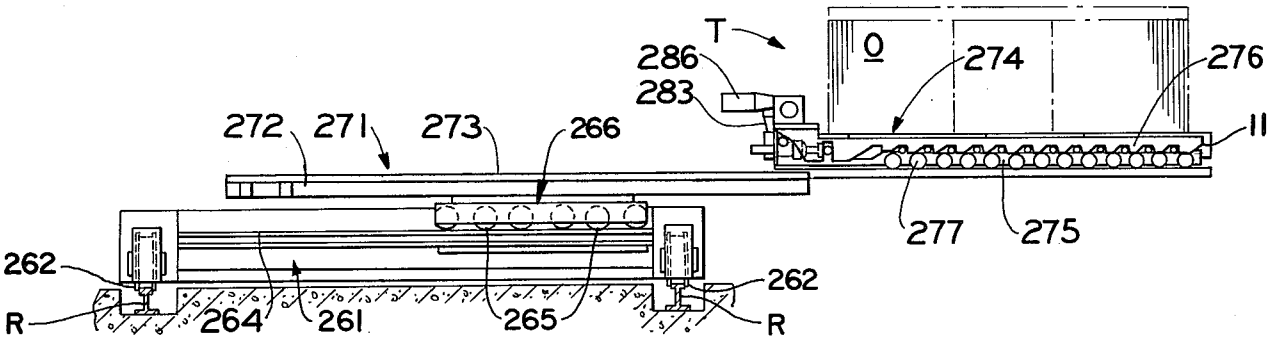
FIG. 31 is a side elevation of the car, the lifting bars being extended but lowered to deposit a coil on a support.

To effect movement of the upper carriage 275 between its retracted position shown in FIG. 29 and its extended position shown in FIG. 30, a motor 286 is mounted in frame 275 of the carriage and through suitable shafts and gearing drives pinions 287 on frame 275 that engage racks 288 on the intermediate carriage 266.

By suitable control of the various motors of the transfer car, therefore, the car can be moved along rails R to a suitable position for loading or unloading a coil or its support unit S or both of them. By suitable actuating of its bars 11 the car is adapted to lift coils or their support units from a position adjacent the car, load them onto the car, then move the car along the rails R to a predetermined position, and extend its bars 11 on suitable supporting rails in the loading or unloading stations or unit S or elsewhere to deposit the coil or its support unit in proper position, and also to remove a coil or its support unit, as described above and hereinafter.

Method of Operation

A preferred method of operation of the apparatus disclosed above and discussed below in connection with diagrammatic FIGS. 32A to 32J inclusive, illustrating certain steps in the method.

It is assumed that initially (FIG. 32A) the furnace enclosure and the purge chambers are all empty of coils and their support units; that the auxiliary walking beams 101 are in the purge chamber 4; that the walking beams 62 are located in the furnace enclosure 16 the end doors 26 and 28 of which are closed but the door 25 into the purge chamber 4 is open; that the door 29 from the purge chamber 5 is also open; that the rail filler beam means 7 has been retracted; and that a coil support unit S is on loading platform 126 where it has been properly located by the pusher means and adjustable slots described.

Figure 32A:
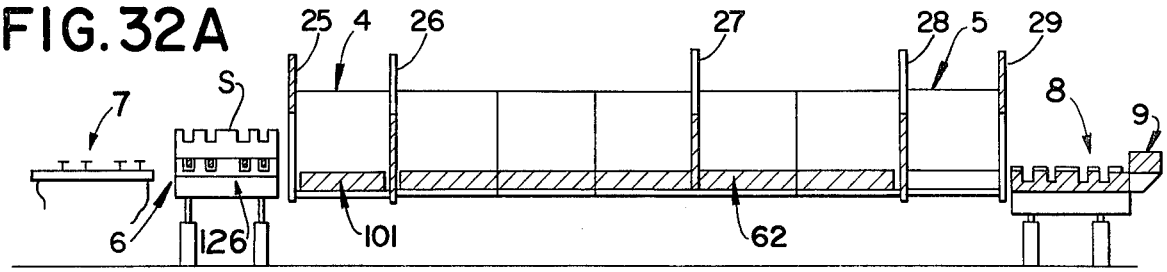
FIGS. 32A to 32J are diagrammatic views to illustrate a method of operation of the apparatus to load coils into the apparatus, fill the apparatus with coils, and unload coils from the apparatus.
Figure 32B:
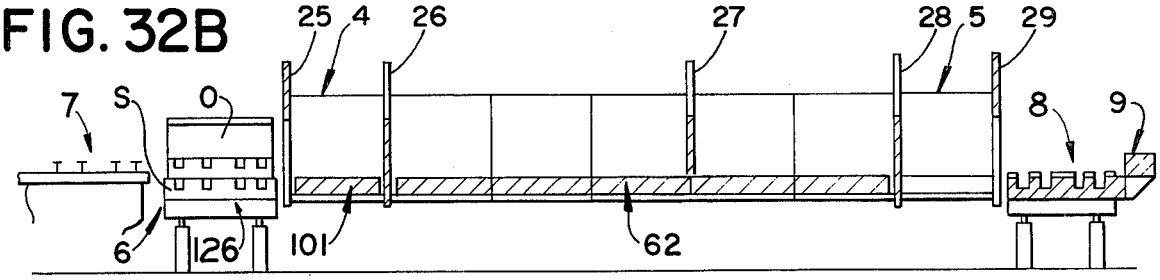
Figure 32C:
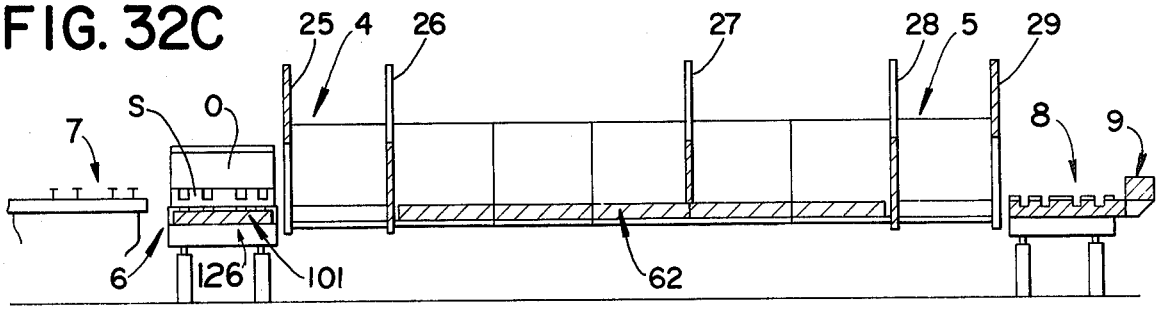

The loading platform is then moved to the proper height to permit the transfer car bars 11 carrying a coil to be moved into the railed slots of the coil support unit S to deposit the coil on unit S. The bars 11 of the transfer car are then lowered as shown in FIG. 31 and withdrawn from unit S. The height of the platform 126 of the loading station in the horizontal plane is the same as the top surfaces of the stationary work supporting portions of the furnace enclosure 16 and in the purge chamber 4, (FIG. 32B).

The heat shield 256 is then placed on the top of the coil, if it had not been previously so placed.

Figure 32D:
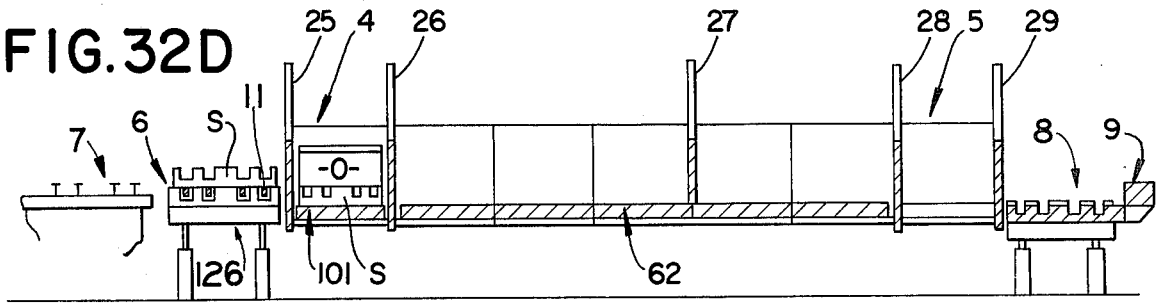
Figure 32E:
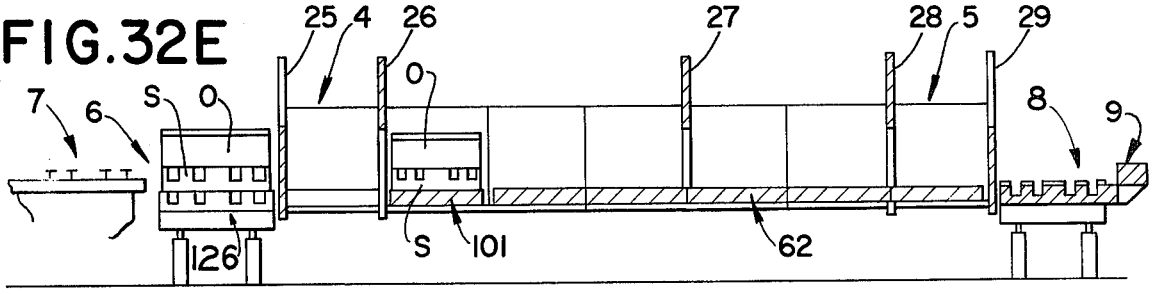
Figure 32F:
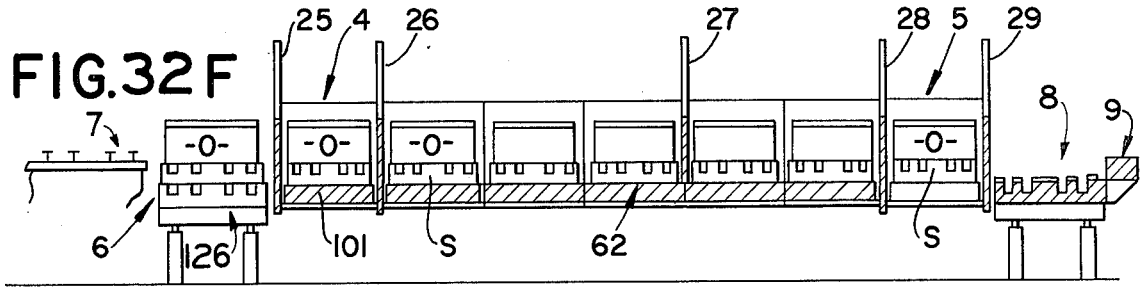
Figure 32G:
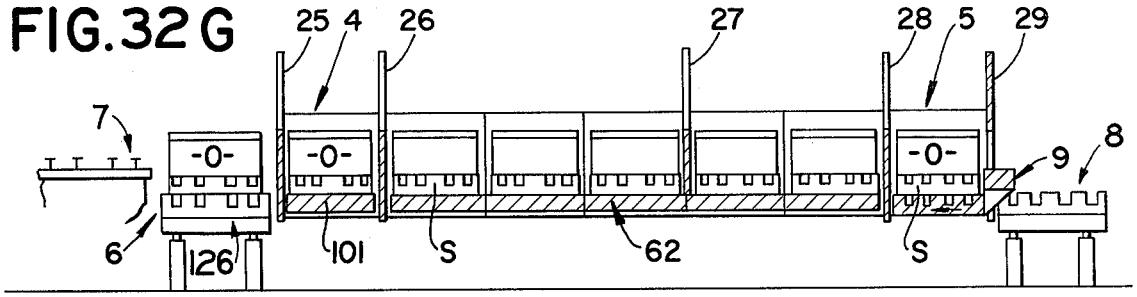

The auxiliary walking beams 101 are then lowered and longitudinally moved by their actuating mechanism into the slots 151 of the loading station beneath the support unit S for coil O on the loading station (FIG. 32C), and then lifted and moved longitudinally to move the coil O and its work supporting unit into the purge chamber 4, after which doors 25 and 29 are closed and the air in the purge chamber is replaced by suitable atmosphere compatible with or the same as the atmosphere in the furnaces enclosure 16 (FIG. 32D). Meanwhile another coil support S and coil O are placed on loading station 6.

Thereafter (FIG. 32E) the auxiliary walking beams 101 are raised and move the coil O and its support S from the purge chamber 4 into heating station H-1, doors 26, 27 and 28 being opened for the purpose. Fan 53 and heating tubes 51 are activated to pass heat treating gas through the coil in station H-1, as described above the coil being held in that station for a predetermined time, depending on the treatment desired.

The above steps are repeated to introduce additional coils O and their support units S into the furnace enclosure 16 all of the coils in the furnace being simultaneously moved by main walking beams 62 one step along the furnace to the succeeding treating station, until the furnace is completely filled, and the last coil has been completely treated and cooled and put into the unloading purge chamber 5 by walking beams 62 (FIG. 32F) the door 27 between the heating and cooling stations being both closed during the heating operations and opened only while the coils are being moved in the furnace entrance from the last heating station H-3 to the first cooling station C-1. The coil in each work station of course, it given treatment for which the work station is designed, being held there for a predetermined time; thus the coils in work stations H-1, H-2, and H-3 are subjected to heat treatment, while those in stations C-1 and C-2 are subjected to cooling treatment. After the last coil has been moved from cooling station C-2 into purge chamber 5, the doors to the purge chamber are closed as in FIGS. 32F and the furnace atmosphere in the chamber 5 removed if desired and replaced by air.

Figure 32H:
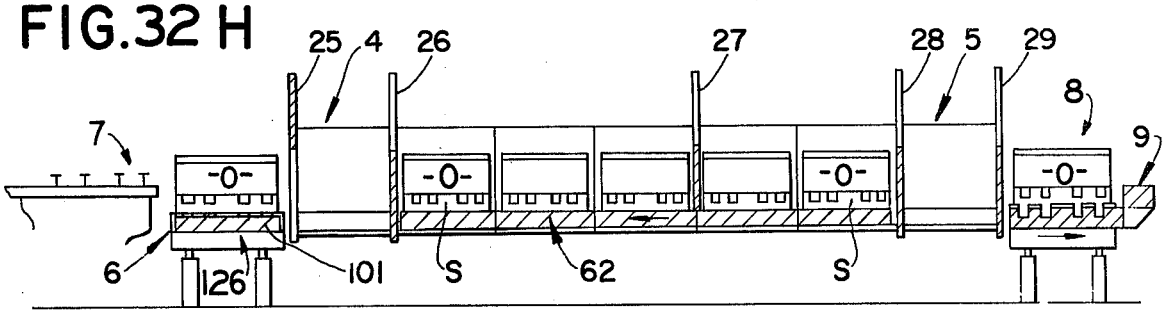
Figure 32I:
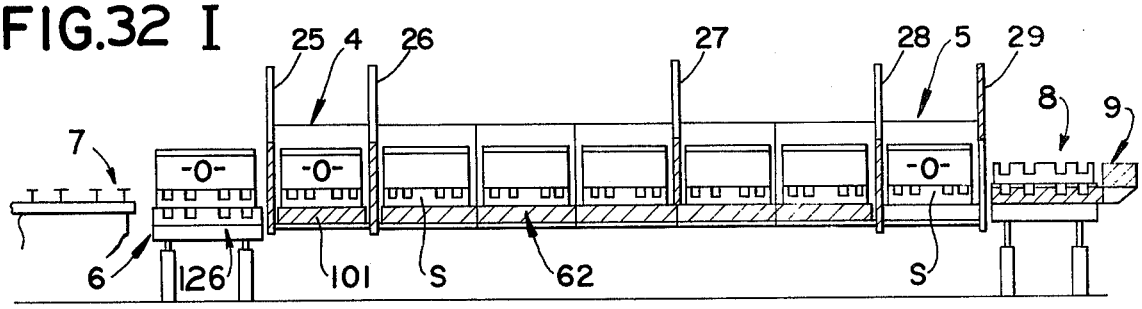

Thereafter (FIG. 32G), the door 29 of purge chamber 5 is opened and transfer beam means 9 is moved as described above, into the purge chamber with the tops of its members 183 below the level of the stationary work supporting portions in the purge chamber, and then lifted and moved out of chamber 5 to carry the last coil and its support unit to the unloading station platform 126, the height of which has been previously properly adjusted, after which the means 9 is lowered to deposit the coil and its support on the unloading station platform (FIG. 32H). Meanwhile the entrance door 25 to purge chamber 4 is opened and the auxiliary walking beams operating between the purge chamber 4 and the loading station 6 have been moved into the loading station 6. While the entrance door 26 into heating station H-1 remains closed, the main walking beam 62 is moved so that its end-most portion is located below the support unit of the coil in treating station H-1 in furnace 1, as shown in FIG. 32H.

Figure 32J:
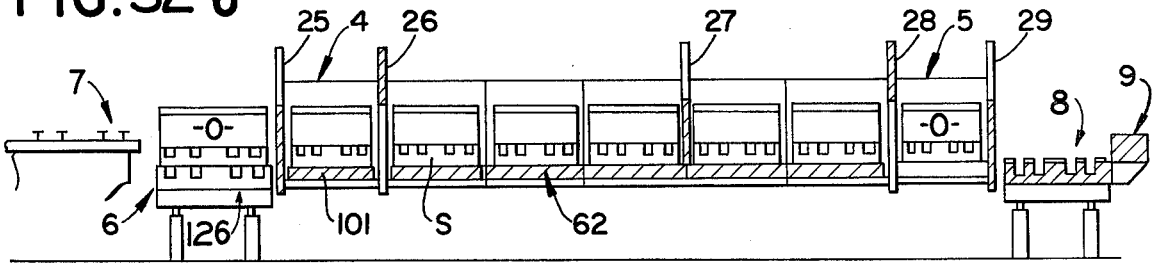

The coil at unloading station 8 is then removed by the transfer car T and the platform of the unloading station is raised so that the lifting bars 11 of the transfer car can then engage and lift a coil support S off and place it on the transfer car (FIG. 32I) for transportation back to the loading station, or elsewhere if desired. The conditions are then as illustrated in FIG. 32J in which a coil and its support unit on the loading station are waiting to enter the furnace, and the coil unloading station is ready to receive a coil and there are coils in both purge chambers and in the furnace.

The process may be repeated as long as desired by placing coils and their support units on the loading station and feeding them into the furnace through the purge chamber 4, and moving the treated coils and their support units from the discharge end of the furnace through the purge chamber 5 and onto and off of the unloading station.

Summary

The invention thus provides improved walking beam apparatus, particularly suitable for treating large and heavy objects, under conditions in which the objects are treated while secluded from the ambient atmosphere. Because of the sealing means at the walking beams, the heating chamber and work contacting portions of the walking beam apparatus can be completely secluded from the atmosphere while actuating portions of the walking beam apparatus are easily available in the ambient atmosphere for maintenance and repair.

The invention also provides means for treating open coils in a longitudinally extending furnace by passing gas between the spaced convolutions of the coil while secluded from the atmosphere. The invention also provides improved loading and unloading means.

As far as the method and apparatus for treating open coils are concerned, the invention provides important advantages in economy and heating, conservation of treating gases, and rapid and effective treatment of coils with a minimum of handling that could cause damage to the coils as well as other important features. It also makes possible the handling and treatment of large, heavy open coils.

For example, apparatus of the type illustrated has been designed to handle and treat open coils of steel strip as large as 19 feet in diameter and 5 feet high, weighing in excess of 300,000 pounds, the strip being 16 to 24 gage metal. The combination of such a coil, its coil support unit, and the heat shield at the top of the coil can weigh approximately 350,000 pounds, so the main walking beams of the illustrated apparatus can lift and move in excess of 1,750,000 pounds at one time.

Production rates of as high as 27,000 tons per month are possible.

Various modifications may be made in the illustrated apparatus. For example, sealing material other than liquid, such as suitable dry particulate material such as sand or the like or a mixture of such particulate material and liquid, may be contained in some or all of the sealing troughs to form seals between the flanges and troughs; in the claims the term "fluent material" is intended to mean liquid or such particulate material or mixture.

Moreover, the sealing troughs may be fixed to the supporting members that move in an upright path, and the cooperating flanges may be stationary, although the illustrated arrangement in which the troughs are stationary and the flanges move is preferable since this reduces problems of maintaining proper levels of fluent material in the troughs, and eliminates possibilities of spillage of sealing liquid or other fluent material in the troughs.

Furthermore, different and more or fewer treating stations, and more or fewer heating stations or cooling stations may be used. Different loading and unloading means may be used than those illustrated, although those illustrated are very advantageous.

Different means from the mechanical jacks illustrated may be used for raising and lowering the walking beams in an upright path.

Moreover, while the invention has been disclosed in connection with the treating of open coils, walking beam apparatus embodying the invention can be used for treating, particularly heat treating, other objects, and in particular heavy objects, in secluded atmospheres.

Various modifications in addition those indicated above will be apparent to those skilled in the art and may be made in the apparatus and method disclosed above, and changes may be made with respect to the features disclosed, provided that the elements set forth in the following claims or the equivalents of such be employed.

I claim:

1. Walking beam apparatus for treating work comprising first laterally and longitudinally extending worksupporting means having an upwardly facing work-supporting surface; second laterally and longitudinally extending work-supporting means located generally parallel to and adjacent to said first work-supporting means and having an upwardly facing work-supporting surface; support means movable solely in a fixed upright path for supporting and moving one of said work-supporting means in an upright path between a position in which its worksupporting surface is above said work-supporting surface of said other work-supporting means, and a position in which its worksupporting surface is below said work-supporting surface of said other work-supporting means; means for moving one of said first and second work-supporting means solely in a lateral longitudinal direction extending generally parallel to the other work-supporting means, while said work-supporting means movable in an upright path is positioned with its work-supporting surface above the work-supporting surface of the other work-supporting means, and in an opposite lateral longitudinal direction when said work-supporting means movable in an upright path is positioned with its work-supporting surface below said work-supporting surface of said other work-supporting means; enclosure means enclosing space above both said work-supporting means, said enclosure means including wall portion means completely surrounding said support means movable in said upright path; and gas seal means operating between said wall portion means of said enclosure means and said support means movable in said upright path to prevent passage of gas between said space above said work-supporting means in said enclosure means and the exterior of said enclosure means by passage of gas between said wall portion means of said enclosure means and said support means movable in said upright path to prevent at all times including during said movement of either of said work-supporting means passage of gas between the space above said work-supporting means and the exterior atmosphere below said work-supporting means.

2. The apparatus of claim 1 in which said gas seal means comprises trough means that surrounds said support means movable in said upright path and that is affixed in gas tight relation to one of said wall portion means of said enclosure means and said support means movable in said upright path, said trough means being adapted to contain fluent material, and gas-impervious flange means that surrounds said support means movable in said upright path and is fixed in gas tight relation to the other of said wall portion means of said enclosure means and said support means movable in said upright path and is adapted to extend into said fluent material in said trough means at all times including during the times said support means moves in said upright path.

3. The apparatus of claim 2 in which said work-supporting means movable in an upright path comprises two spaced generally parallel work-supporting beam means, each of which is supported by support means surrounded by said trough means and said flange means.

4. The apparatus of claim 3 in which each of said beam means has an individual support means which is surrounded by an individual trough means and an individual flange means.

5. The apparatus of claim 2 in which said trough means is stationary and fixed in gas tight relation to said wall portion means surrounding said support means movable in said upright path, and said flange means is fixed in gas tight relation to said support means movable in said upright path and moves with it.

6. Walking beam apparatus for treating work comprising base means; first laterally and longitudinally extending work-supporting means having an upwardly facing work-supporting surface; second laterally and longitudinally extending work-supporting means located generally parallel to and adjacent to said first work-supporting means and having an upwardly facing worksupporting surface and supported from said base means; support means for supporting said first work-supporting means from said base means, said support means being movable in a fixed upright path relative to said base means for moving said first work-supporting means in an upright path between a higher position in which the worksupporting surface of said first work-supporting means is above the work-supporting surface of said second work-supporting means and a lower position in which the work-supporting surface of said first work-supporting means is below the work-supporting surface of said second work-supporting means, said support means supporting said first work-supporting means on said support means for reciprocable lateral longitudinal movement relative to said base means and generally parallel to said second work supporting means; means for so moving said support means in said fixed upright path; means for so moving said first worksupporting means in one lateral direction while said first work-supporting means is in said higher position and in the opposite lateral direction while said first work supporting means is in said lower position; enclosure means enclosing space above said first and second work-supporting means, said enclosure means being supported from said base means and having wall portion means connected gas-tight to said second work-supporting means and extending downwardly below said work-supporting surfaces of both of said work-supporting means and completely surrounding said support means for said first work-supporting means; and gas seal means operating between said surrounding wall portion means of said enclosure means and said support means for said first work-supporting means to prevent passage of gas between the space above said work-supporting means and the exterior of said enclosure means by passage of gas between said wall means of said enclosure means and said work-supporting means.

7. The apparatus of claim 6 in which said gas seal means comprises trough means that surrounds said support means for said first work-supporting means and that is affixed in gas tight relation to one of said wall portion means of said enclosure means and said support means for said first work-supporting means, said trough means being adapted to contain fluent material, and gas impervious flange means that surrounds said support means for said first work-supporting means and is fixed in gas tight relation to the other of said wall portion means of said enclosure means and said support means for said first work-supporting means and is adapted to extend into said fluent material in said trough means at all times including during the time said work-supporting means moves in said upright path.

8. The apparatus of claim 7 in which said first work-supporting means comprises two spaced generally parallel work-supporting beam means, each of which is supported by support means surrounded by said trough means and said flange means.

9. The apparatus of claim 7 in which said trough means is stationary relative to said base means and fixed in gas tight relation to said wall portion means surrounding said support means for said first work-supporting means, and said flange means is fixed in gas tight relation to said support means for said first work-supporting means and moves with said support means.

10. The apparatus of claim 8 in which each of said beam means has a support member that is movable in a fixed upright path, and in which there is a stationary individual trough means surrounding each of said supporting members and fixed gas tight to wall portion means surrounding said member, and in which there is for each of said beam means an individual flange means that is fixed gas tight to said support member for said beam means and moves with said support member and that extends into fluent material in the trough means surrounding said support member.

11. Walking beam apparatus for treating work comprising first laterally and longitudinally extending work-supporting means having an upwardly facing work-supporting surface; second laterally and longitudinally extending work-supporting means located generally parallel to and adjacent to said first work-supporting means and having an upwardly facing worksupporting surface; support means movable solely in a fixed upright path for supporting and moving said first work-supporting means between a higher position in which its work-supporting surface is above said work-supporting surface of said second work-supporting means, and a lower position in which its work-supporting surface is below said work-supporting surface of said second work-supporting means; means for moving one of said first and second work-supporting means solely in a lateral longitudinal direction extending generally parallel to the other work-supporting means, while said first work-supporting means is in a higher position with its work-supporting surface above said work-supporting surface of said second work-supporting means, and in an opposite lateral longitudinal direction when said first work-supporting means is in a lower position with its work-supporting surface below said work-supporting surface of said second work-supporting means; enclosure means enclosing space above both said work-supporting means and adapted to be opened to permit work to be introduced into said enclosure means and adapted to be closed after introduction of work for treatment in said enclosure means, said enclosure means being substantially impervious to passage of gas between the interior and exterior of said enclosure means after being closed, said enclosure means including wall portion means completely surrounding said support means for said first work-supporting means; and gas seal means operating between said surrounding wall portion means of said enclosure means and said support means for said first work-supporting means to prevent passage of gas between the interior and exterior of said enclosure means by passage of gas past the support means for said first worksupporting means at all times during movement of said first worksupporting means.

12. The apparatus of claim 11 in which said gas seal means comprises trough means that surrounds said support means for said first work-supporting means and that is affixed in gas sealing relation to one of said wall portion means of said enclosure means and said support means for said first worksupporting means, said trough means being adapted to contain fluent material, and gas-impervious flange means that surrounds said support means for said first work-supporting means and is fixed in gas tight relation to the other of said wall portion means of said enclosure means and said support means for said first work-supporting means and is adapted to extend into said fluent material in said trough means at all times including during the time said work-supporting means moves in said upright path.

13. The apparatus of claim 12 in which said first work-supporting means comprises two spaced generally parallel work-supporting beam means, the support means for each of which is surrounded by said trough means and said flange means.

14. The apparatus of claim 12 in which said trough means is stationary and fixed in gas tight relation to said wall portion means surrounding said support means for said first work-supporting means, and said flange means is fixed in gas tight relation to said support means for said supporting means for said first work-supporting means and moves with said support means.

15. The apparatus of claim 13 in which each of said beam means has a supporting member that is movable in a fixed upright path, and in which there is a stationary individual trough means surrounding each of said supporting members and fixed gas tight to wall portion means surrounding said member, and in which there is for each of said beam means an individual flange means that is fixed gas tight to said supporting member for said beam means and moves with said support member and extends into fluent material in the trough means surrounding said support member.

16. Walking beam apparatus for treating work comprising first movable laterally and longitudinally extending work-supporting beam means having an upwardly facing work-supporting surface; second laterally and longitudinally extending work-supporting means located generally parallel to and adjacent to said first work-supporting beam means and having an upwardly facing work-supporting surface; support means for supporting said first work-supporting beam means, said support means being movable in a fixed upright path for moving said first work-supporting beam means between a position in which its work-supporting surface is above the work-supporting surface of said second work-supporting means and a position in which its work-supporting surface is below the work-supporting surface of said second work-supporting means, said support means supporting said first work-supporting beam means on said support means for reciprocable movement in a generally lateral horizontal path that is fixed relative to said support means and extends longitudinally of said first and second work-supporting means; means for so moving said support means in said fixed upright path; means carried by said support means for so moving said first work-supporting beam means in said lateral path; enclosure means enclosing the space above said first work-supporting beam means and said second work-supporting means, said enclosure means having gas tight lower portion means surrounding said support means for said first work-supporting beam means; and gas seal means operating between said lower portion means of said enclosure means and said support means for said first work supporting beam means to prevent passage of gas between the space within said enclosure means and the exterior of said enclosure means by passage of gas between said first work-supporting beam means and said lower portion means of said enclosure.

17. The apparatus of claim 16 in which said gas seal means comprises trough means that surrounds said support means for said first work-supporting beam means and that is affixed in gas tight relation to one of said lower enclosure portion means and said support means for said first work-supporting beam means, said trough means being adapted to contain fluent material, and gas impervious flange means that surrounds said support means for said first work-supporting beam means and is fixed in gas tight relation to the other of said lower enclosure portion means and said support means for said first work-supporting beam means and that is adapted to extend into said fluent material in said trough means at all times including during the times said support means for said first work-supporting beam means moves in said upright path.

18. The apparatus of claim 17 in which said first work-supporting beam means comprises two spaced generally parallel work-supporting beam means, the support means for each of which is surrounded by said trough means and said flange means.

19. The apparatus of claim 18 in which each of said beam means has an individual support means which is surrounded by an individual trough means and an individual flange means.

20. The apparatus of claim 17 in which said trough means is stationary and fixed in gas tight relation to said lower enclosure means portion, and said flange means is fixed in gas tight relation to said support means for said first work supporting beam means and is movable with it.

21. The apparatus of claim 1 in which said work-supporting means that moves in a lateral longitudinal direction comprises a plurality of work-supporting beam means that are connected end-to-end to move in unison in said lateral longitudinal direction and that are supported by said support means so that they move in unison in said upright path with all their work-supporting surfaces at the same elevation relative to each other.

22. The apparatus of claim 21 in which there is a separate gas seal means for each of said worksupporting beam means.

23. The apparatus of claim 6 in which said first work-supporting means comprises a plurality of worksupporting beam means that are connected end-to-end and are moved longitudinally and laterally in unison, and in which there is a plurality of support means for said beam means adapted to move in unison in upright paths to raise and lower said beam means in unison, each of said support means being surrounded by enclosure wall portion means and having gas seal means operating between said surrounding wall portion means of said enclosure means and said individual support means.

24. Apparatus for treating objects comprising a treating chamber in which said objects are subjected to a treating gas and adapted when closed to be essentially secluded from the atmosphere; a purge chamber at an end of said treating chamber through which purge chamber objects being treated pass between said treating chamber and the atmosphere, said purge chamber having first door means between the interior of said purge chamber and the atmosphere and second door means between said purge chamber and the treating chamber; walking beam means in said treating chamber adapted to move objects being treated through said treating chamber between a treating station in said treating chamber that is adjacent said purge chamber and a location in said treating chamber that is removed from said purge chamber and said treating station; and auxilary walking beam means adapted to move an object being treated between the exterior of said purge chamber and the interior of said purge chamber when said first door means is opened and said second door means is closed to permit such movement without harmful effects on the treating gas in said treating chamber.

25. The apparatus of claim 24 in which said auxiliary walking beam means is adapted to move from the exterior of said purge chamber into the interior of said purge chamber when said first door means is opened and said second door means is closed, and then to move from said purge chamber into said treating chamber to said treating station in said treating chamber when said first door means is closed and said second door means is open, and in which said auxiliary walking beam means is adapted then to move completely out of said treating chamber and said purge chamber when said second door means is opened and then closed and said first door means is closed and then opened.

26. The apparatus of claim 25 in which said purge chamber is at the entrance end of said treating chamber, said treating station is the initial treating stating in said treating chamber, and said auxiliary walking beam means is adapted to transfer an object to be treated from the exterior of said purge chamber into the interior of said purge chamber, then from the interior of said purge chamber into said initial treating station in said treating chamber, and said auxiliary walking beam means is adapted then to be moved from said treating chamber through said purge chamber to the exterior of said purge chamber.

27. The apparatus of claim 24 in which said walking beam means in said treating chamber is adapted to move between said treating station in said treating chamber into said purge chamber and back into said treating station, and said auxiliary walking beam means is adapted to move between the exterior of said purge chamber into said purge chamber and out of said purge chamber.

28. The apparatus of claim 27 in which said purge chamber is at the discharge end of said treating chamber, and in which said walking beam means in said treating chamber is adapted to move an object to be discharged from said treating chamber into said purge chamber and deposit the object there and then move back into said treating chamber, and in which said auxiliary walking beam means is adapted to move into said purge chamber and remove said object deposited there to the exterior of said purge chamber.

29. A coil support for supporting an open coil of spirally wound spaced convolutions between the spaces of which convolutions treating gas is to be passed while the coil is supported on the coil support, said coil support being of generally laterally extending configuration and having a side and top, the top being provided with opening means to permit passage of gas between the coil support and the spaces between the convolutions of the coil; means in said coil support providing gas passages extending between at least one gas opening means in said side of said coil support and said opening means in the top of said coil support so that gas can pass between the opening means at the side of said coil support through said opening means at the top of said coil support and through said spaces between the convolutions of said coil; means in said coil support providing at least one passage adapted to receive transfer means for supporting said coil support, which passage communicates with said gas opening means and has entrance opening means for said transfer means in a side of said coil support at a location remote from said gas opening means; and closure means for said entrance opening means of said passage for said transfer means to permit said entrance opening means to be closed while treating gas passes through said gas opening means in the side of said coil support, through said opening means in the top of said coil support and through the spaces between the convolutions of said coil, said closure means permitting said entrance opening means of said passage for said transfer means to be opened when transfer means is to be entered into said passage in said coil support; and means for supporting said coil on said coil support.

30. The apparatus of claim 29 comprising a rigid frame; laterally extending gas-impervious wall means carried by said frame; and wall means upstanding from said laterally extending wall means and defining said gas passages and said passage for said transfer means, and adapted to support an open coil.

31. The apparatus of claim 30 in which said upstanding wall means are formed of corrugated metal in which the corrugations extend upwardly.

32. The apparatus of claim 2 in which said trough means has side portions extending parallel to the direction of movement of said work supporting means that moves in lateral longitudinal directions and end portions that extend transversely of said direction of movement of said work-supporting means, and in which the widths of said end portions of said trough means is substantially less than the distance through which said longitudinally extending work-supporting means that moves in said lateral longitudinal directions.

33. The apparatus of claim 9 in which said trough means has side portions extending generally parallel to the direction of lateral movements of said first work-supporting means, and end portions that extend transversely of said direction of movement of said first work-supporting means, and in which the widths of said end portions of said trough means are substantially less than the distance through which said first work-supporting means moves in said lateral movements.

34. The apparatus of claim 17 in which said trough means has side portions extending generally parallel to the direction of lateral movement of said first work-supporting beam means and end portions that extend transversely of said path of movement of said first work-supporting beam means, and in which the widths of said end portions of said trough means are substantially less than the distance through which said first work-supporting beam means moves in said lateral path of movement.

35. The apparatus of claim 6 in which said means for moving said first work-supporting means in said generally horizontal direction is carried by said support means.

36. The apparatus of claim 1 in which said enclosure means is elongated and encloses along its length a plurality of spaced treating stations each of which is adapted to treat an open coil of strip metal having spaced convolutions in the coil by passing treating gases through the spaces between the convolutions of the coil, and in which the distance that said work supporting means that moves in said lateral directions laterally moves while its work-supporting surface is above the work-supporting surface of the other work-supporting means is essentially equivalent to the distance between said treating stations, so that said first work supporting means that moves in said lateral directions supports and moves an open coil from one treating station to a succeeding treating station in one lateral movement of said work-supporting means.

37. The apparatus of claim 9 in which said enclosure means is elongated and encloses along its length a plurality of spaced treating stations each of which is adapted to treat an open coil of strip metal having spaced convolutions in the coil by passing treating gases through the spaces between the convolutions of the coil, and in which the distance that said first work-supporting means moves in its said lateral movement while its work-supporting surface is above the work-supporting surface of the second work-supporting means is essentially equivalent to the distance between said treating stations, so that said first work-supporting means supports and moves an open coil from one treating station to a succeeding treating station in one lateral movement of said first work-supporting means.

38. The apparatus of claim 16 in which said enclosure means is elongated and along its length encloses a plurality of spaced treating stations each of which is adapted to treat an open coil of strip metal having spaced convolutions in the coil by passing treating gases through the spaces between the convolutions of the coil, and in which the distance that said first work supporting beam means moves in said lateral path while its worksupporting surface is above the work-supporting surface of the second work-supporting means is essentially equivalent to the distance between said treating stations, so that said first work-supporting beam means that moves in a generally horizontal longitudinal direction supports and moves an open coil from one treating station to a succeeding treating station in one movement of said work-supporting beam means.

39. The apparatus of claim 24 in which said treating chamber comprises a plurality of spaced treating stations each of which is adapted to treat an open coil of strip metal having spaced convolutions in the coil by passing treating gases through the spaces between the convolutions of the coil, and in which said walking beam means in said treating chamber includes coil moving beam means adapted to support and move an open coil from one treating station in said chamber to a succeeding treating station in said chamber in a single lateral movement of said beam means.

* * * * *